US009047607B1

(12) United States Patent
Curial et al.

(10) Patent No.: US 9,047,607 B1
(45) Date of Patent: Jun. 2, 2015

(54) METHOD, MEDIUM, AND SYSTEM FOR DETERMINING ELIGIBILITY FOR A LOCATION-BASED SHIPPING OPTION FOR FULFILLMENT NETWORKS

(75) Inventors: Stephen M. Curial, Seattle, WA (US); Gregory S. Miller, Seattle, WA (US); Jeffery T. Moore, Seattle, WA (US); Dylan Nooney, Seattle, WA (US); Henry S. Ng, Renton, WA (US); Huy Quang Dang, Seattle, WA (US); Ashwin S. Khandeparker, Seattle, WA (US)

(73) Assignee: Amazon Technologies, Reno, NV (US)

( * ) Notice: Subject to any disclaimer, the term of this patent is extended or adjusted under 35 U.S.C. 154(b) by 411 days.

(21) Appl. No.: 13/532,574

(22) Filed: Jun. 25, 2012

(51) Int. Cl.
*G06Q 30/00* (2012.01)

(52) U.S. Cl.
CPC ..... *G06Q 30/00* (2013.01)

(58) Field of Classification Search
CPC . G06Q 10/083; G06Q 30/00; G06Q 30/0639; G06Q 50/28
USPC ..... 705/26.1, 27.1
See application file for complete search history.

(56) References Cited

U.S. PATENT DOCUMENTS

| | | | | |
|---|---|---|---|---|
| 7,590,563 | B1 | 9/2009 | Ward et al. | |
| 7,590,565 | B2 | 9/2009 | Ward et al. | |
| 8,306,838 | B2 | 11/2012 | Heise et al. | |
| 2006/0173749 | A1* | 8/2006 | Ward et al. | 705/26 |
| 2006/0195364 | A1* | 8/2006 | Shroff et al. | 705/26 |
| 2009/0063215 | A1 | 3/2009 | Heise et al. | |
| 2012/0084129 | A1* | 4/2012 | Golden et al. | 705/14.23 |
| 2012/0253892 | A1 | 10/2012 | Davidson | |

OTHER PUBLICATIONS

Feb. 2009—https://web.archive.org/web/20090210034013/http://askville.amazon.com/amazon-prime/AnswerViewer.do?requestId=4687799.*

* cited by examiner

*Primary Examiner* — Matthew Zimmerman
(74) *Attorney, Agent, or Firm* — Robert C. Kowert; Meyertons, Hood, Kivlin, Kowert & Goetzel, P.C.

(57) ABSTRACT

Methods, systems and apparatus are described for determining eligibility for a location-based shipping option for multiple fulfillment networks. Embodiments may send display information to a user in response to a user request for display information for one or more items offered on a network-based site. The display information may be configured to indicated whether items are eligible for an enhanced shipping option based upon the shipping origin of the item and a predicted shipping destination. Some embodiments may provide multiple fulfillment networks with the enhanced shipping option. Some of the fulfillment networks may be controlled by an entity different from the entity controlling the network-based site. In some embodiments the enhanced shipping option is an option within a subscription-based shipping program for the network-based site.

25 Claims, 15 Drawing Sheets

Manage order user interface
1000

Order Search List 1010

Search Type 1011 | Search Range 1012 | Search 1013

Order Search Results 1020

| Order Date 1021 | Order ID – Item Details 1022 | Shipping Destination 1023 | Shipping Option 1024 | Order Status 1025 | Action 1026 |
|---|---|---|---|---|---|
| 02/05/12 | Order No. : 1111-12345<br>Widget A (Product No. 3498)<br>Quantity: 2 | Big Town, USA | Location-based program | Open | Print Label |
| 02/05/12 | Order No. : 1111-12384<br>Widget C (Product No. 3505)<br>Quantity: 1 | Big Suburb, USA | Location-based program | Open | Print Label |
| 02/05/12 | Order No. : 1111-12453<br>Widget B (Product No. 3502)<br>Quantity: 2 | Small Town, USA | Standard | Closed | |
| 02/05/12 | Order No. : 1111-12465<br>Widget A (Product No. 3498)<br>Quantity: 1 | Big Suburb, USA | Location-based program | Open | Print Label |
| 02/05/12 | Order No. : 1111-12521<br>Widget C (Product No. 3505)<br>Quantity: 5 | Big Town, USA | Location-based program | Open | Print Label |

*FIG. 10*

METHOD, MEDIUM, AND SYSTEM FOR DETERMINING ELIGIBILITY FOR A LOCATION-BASED SHIPPING OPTION FOR FULFILLMENT NETWORKS

BACKGROUND

Manufacturers, retailers, wholesalers, and distributors typically maintain an inventory of various items that may be ordered and shipped to clients or customers. This inventory may be maintained and processed at a materials handling facility or facilities such as distribution centers, cross-docking facilities, and order fulfillment facilities (which may be collectively referred to as distribution centers). Fulfillment networks may include one or more distribution centers and may be operated by a distributor, manufacturer, retailer, or wholesalers, for example. Generally, fulfillment networks may receive orders for items stored in inventory, retrieve the ordered items, and ship the items to the ordering customer's destination.

With the recent and staggering growth of electronic based commerce, virtual storefronts are increasing their offerings to compete in greater numbers with "brick and mortar" stores. In order to compete with the advantage of traditional stores, namely the near instant receipt of purchased items, virtual storefronts are developing innovative systems to approximate the same experience. For example, subscriber-based shipping programs are one method that virtual storefronts have developed to increase consumer confidence in the ability of virtual storefronts to quickly and easily place purchase items into the hands of consumers. As virtual storefronts grow in scale, the fulfillment networks that supply the items offered by virtual storefronts are increasingly controlled by distinct entities that may provide their own various methods for delivering purchased items to customers.

BRIEF DESCRIPTION OF THE DRAWINGS

FIG. 10 illustrates an exemplary manage order user interface, via which an agent of a fulfillment network may access to manage item orders, according to some embodiments.

Figure 1:
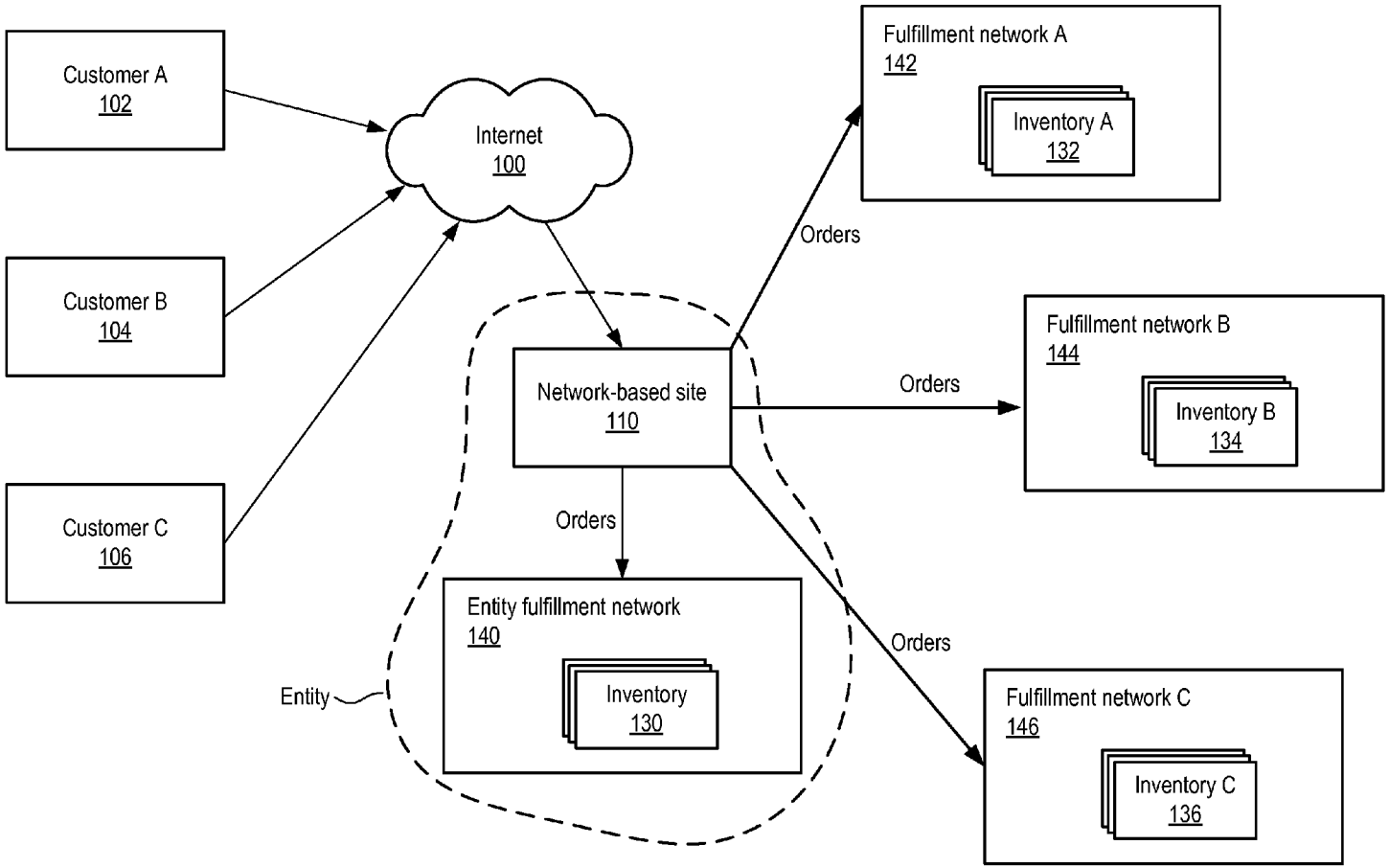
FIG. 1 illustrates an example operating environment for a network-based site that implements determining eligibility for a location-based shipping option for multiple fulfillment networks, according to some embodiments.

While the invention is described herein by way of example for several embodiments and illustrative drawings, those skilled in the art will recognize that the invention is not limited to the embodiments or drawings described. It should be understood, that the drawings and detailed description thereto are not intended to limit the invention to the particular form disclosed, but on the contrary, the intention is to cover all modifications, equivalents and alternatives falling within the spirit and scope of the present invention. The headings used herein are for organizational purposes only and are not meant to be used to limit the scope of the description. As used throughout this application, the word "may" is used in a permissive sense (i.e., meaning having the potential to), rather than the mandatory sense (i.e., meaning must). Similarly, the words "include", "including", and "includes" mean including, but not limited to.

DETAILED DESCRIPTION OF EMBODIMENTS

In the following detailed description, numerous specific details are set forth to provide a thorough understanding of claimed subject matter. However, it will be understood by those skilled in the art that claimed subject matter may be practiced without these specific details. In other instances, methods, apparatus, or systems that would be known by one of ordinary skill have not been described in detail so as not to obscure claimed subject matter.

It will also be understood that, although the terms first, second, etc. may be used herein to describe various elements, these elements should not be limited by these terms. These terms are only used to distinguish one element from another. For example, a first contact could be termed a second contact, and, similarly, a second contact could be termed a first contact, without departing from the scope of the present invention. The first contact and the second contact are both contacts, but they are not the same contact.

The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

Various embodiments of a method, system, and apparatus for determining eligibility for a location-based shipping option for fulfillment networks are described. Embodiments may send display information to a user for one or more items that may be selected for order in response to a user request to a network-based site. Before one of the items is selected by a user, embodiments may determine whether the item is eligible for an enhanced shipping option based upon the shipping origin of the item and a predicted shipping destination for the item. In some embodiments, this determination may be based on whether the item can be shipped by a shipping entity from the shipping origin to arrive at the predicted shipping destination within a timeframe for the enhanced shipping option using a cost-effective shipping technique. A cost-effective shipping technique may be a shipping technique such as ground shipping that may be a lower cost shipping technique than other shipping techniques, such as air shipping, that can ship the item from the origin to predicted destination within the timeframe for the enhanced shipping option. In some embodiments, a cost-effective shipping technique may be a shipping technique having a shipping cost below a predefined threshold. Display information sent to the user may be configured to indicate whether a particular item is eligible for the enhanced shipping option.

Some embodiments may allow users of network-based sites to order items offered by the network-based site with an enhanced shipping option. Users may order items offered by one or more fulfillment networks. Some fulfillment networks may be operated or controlled by one or more entities. Moreover, some fulfillment networks may be controlled by entities distinct from an entity controlling the network-based site. For example, a "brick and mortar" store may offer for order certain items, such as action figures, it currently carries in its physical store inventory on a network-based site that it does not own or control. Some of these distinctly controlled fulfillment networks may fulfill items that are eligible for an enhanced shipping option offered by the network-based site. In the above example, a customer may order one of the store's action figures through the network-based site with an enhanced shipping option that the store's items, the action figures, are eligible for.

Eligibility for the enhanced shipping option may be determined, in various embodiments, according to a particular item's shipping origin and the user's predicted shipping destination. Embodiments may determine a particular item's shipping origin by accessing a database that contains the particular item's information, such as the shipping origin. Determining a user's predicted shipping destination may implemented in various ways. In some embodiments, user information accessible on database may provide a default shipping or billing address. Embodiments may also identify the internet protocol (IP) address of the user request and perform a geolocation technique on the IP address to determine a location for the predicted shipping destination. Users may supply a shipping destination, which may be used as the predicted shipping destination.

Embodiments may determine eligibility for an enhanced shipping option by determining one or more shipping timeframes, according to the shipping origin and the predicted shipping destination. Timeframes may be determined by supplying the shipping origin and predicted shipping destination to one or more shipping carriers who return a shipping timeframe based upon the submitted information. Some embodiments may access shipping performance data and calculate a shipping time frame based on the shipping origin and the predicted shipping destination using the shipping performance data. Embodiments may obtain from a shipping carrier delivery destinations, such as a list of postal codes, according to a shipping origin and a specified delivery timeframe and determine whether the predicted shipping destination is one of the obtained delivery destinations in order to determine whether a particular item is eligible for an enhanced shipping option. In some embodiments, the shipping carrier may indicate a delivery area in which items can be shipped from the origin within the specified delivery timeframe using a cost-effective shipping technique. A cost-effective shipping technique may be a shipping technique such as ground shipping that may be a lower cost shipping technique than other shipping techniques, such as air shipping, that can ship the item from the origin to a destination within the delivery area within the timeframe for the enhanced shipping option. In some embodiments, the shipping carrier may provide the shipping cost of shipping an item according to the timeframe which may compared to a predefined threshold for shipping the item with the enhanced shipping option.

A user may, in various embodiments, select one or more items for order. Display information sent to a user may provide a user interface configured to accept a user order for a particular item. A user interface may display one or more user interface elements configured to select a shipping option for a particular item. Embodiments may generate an order for the selected one or more items. An order may contain shipping information for a particular shipping carrier, such as a shipping label and/or shipping tracking identifier. The order may be sent to the corresponding fulfillment network. Various embodiments may record an order in a database.

Some embodiments may use the shipping tracking identifier to determine a delivery time for an item. If the delivery time exceeds a specified delivery timeframe, some embodiments may perform a corrective action. A corrective action may be sending an order fulfillment reminder to a fulfillment network, or sending a cancellation order for the item to the fulfillment network and sending the order to another fulfillment network.

In at least some embodiments, a user may be a subscriber of a subscription-based shipping program. A subscription-based shipping program may be offered by a network-based site providing subscribers with a plurality of shipping options for items ordered at the network-based site. In some embodiments, the enhanced shipping option is one of many shipping options available to subscribers of a subscription-based shipping program. For subscribers, some embodiments may determine whether items offered by fulfillment networks controlled by an entity distinct from the entity controlling the network-based site are eligible for the subscription-based shipping program.

Some embodiments may provide a fulfillment network access to a user interface. A user interface may contain various user interface elements which display orders sent to the fulfillment network. Embodiments may allow a fulfillment network to retrieve shipping information for an order, such as shipping labels and/or shipping tracking identifiers.

Embodiments may obtain a request from a fulfillment network to submit additional items for offer on a network-based site for an enhanced shipping option. In response, some embodiments may provide the requesting fulfillment network with access to a user interface. The user interface may display submission user interface elements configured to obtain information concerning an item, such as the identifier of an item, the quantity of an item, and the location of an item. Some embodiments may determine whether the fulfillment network is eligible for the enhanced shipping option.

Embodiments may be implemented in various network-based sites, such as a virtual marketplace or websites that support e-commerce. These network-based sites may provide other entities, such as online merchants, manufacturers, retailers, and distributers with opportunities to offer items for order on the network-based site. A network-based sited may offer an enhanced shipping option to users that specifies certain shipping services for an item ordered with the enhanced shipping option. An enhanced shipping option may be a location-based shipping option, dependent on the shipping origin of an offered item and the predicted shipping destination of a user who may order the item. An enhanced shipping option may be a shipping option that can be used based on the cost of shipping from the location of the shipping origin and predicted shipping destination. Offered services for an enhanced shipping option include, but are not limited to, free and/or reduced-rate shipping for eligible items ordered on the network-based site.

An enhanced shipping option may also be a component of a subscription-based shipping program offered by a network-based site. A subscription-based shipping program, more generally, may provide mechanisms that allow users of network-based sites to pay a fee to obtain a subscription or membership in a shipping program offered to customers of the network-based site for a period (e.g., a month, six months, a year, etc.) that provides the users with free and/or reduced-rate shipping for at least some items ordered from the network-based site during the period covered by the subscription. In embodiments, in paying for a subscription to the program, a user may essentially be pre-paying a fixed shipping charge for a period (a month, six months, a year, etc.) instead of paying a per-order shipping charge based upon the number of items ordered, the size and/or weight of the items, or other factors. Instead of users paying per-unit charges for every order for shipping, embodiments may provide a subscription-based shipping program with a fixed subscription, and thus shipping, cost for the subscriber.

A subscription-based shipping program may, in some embodiments, allow any user of the network-based site to pay an annual membership fee to receive benefits including, but not limited to: free 2-day shipping on ordered items, or free standard shipping if 2-day shipping is not available for an item; next-day shipping on ordered items at a reduced cost per item; shipping either to the subscriber's address or to third-party addresses; and the ability to share the membership at no additional charge with one or more other users, such as residents of the same household (there may be an upper limit on the number or relationships of other customers that the membership may be shared with).

Note that the above is an example of a subscription-based shipping program and is not intended to be limiting; other implementations may be set up differently. For example, other implementations may provide only one discounted or free shipping method for subscribers to the program (e.g., free 2-day shipping), or more than two discounted and/or free shipping options for subscribers the program. As another example, implementations may issue subscriptions to the program for different periods or using other models; for example, implementations may offer one or more of monthly subscriptions, bi-annual subscriptions, annual subscriptions, and lifetime memberships. Some implementations may offer various combinations, such as monthly subscription for the first year, and then annual subscription thereafter. Some implementations may offer tiered subscriptions, wherein users may opt to subscribe for different periods for different fees; for example, an enterprise may offer one month, six month, annual, and lifetime memberships or subscriptions to the shipping program for different subscription fees. In general, various implementations may offer subscriptions or memberships in the program of any arbitrary duration and not strictly of regular durations. Also note that embodiments may offer other benefits to the subscriber(s), for example exclusive and/or first access to special items or special offers, and/or special "fast track" handling of the subscribed user's orders.

Note that, while the term "order" is generally used herein in terms of a user purchasing an item from an network-based site, an "order" as used herein may also refer to a rental, a lease, an exchange, or any other transaction that might occasion a shipment of one or more items to or on behalf of users using an enhanced shipping option.

Operating Environment for a Network-Based Site with Multiple Fulfillment Networks As described above, embodiments may be implemented in various network-based sites, such as a virtual marketplace, or any network-based site that provides other entities, such as online merchants, manufacturers, retailers, and distributers with opportunities to offer items for order on the network-based site. A network-based site may be controlled by a single entity or single group of entities. This same entity or group of entities may also control a fulfillment network which offers items on the network-based site. Communications between the network-based site and this fulfillment network may operate through public communication channels, such as a public network like the Internet, or private communication channels, such as a mutually accessible inventory management system. A network-based site may communicate orders to the fulfillment network and receive information concerning offered items from the fulfillment network, such as the item quantity, shipping origin, or identification numbers.

Figure 15:
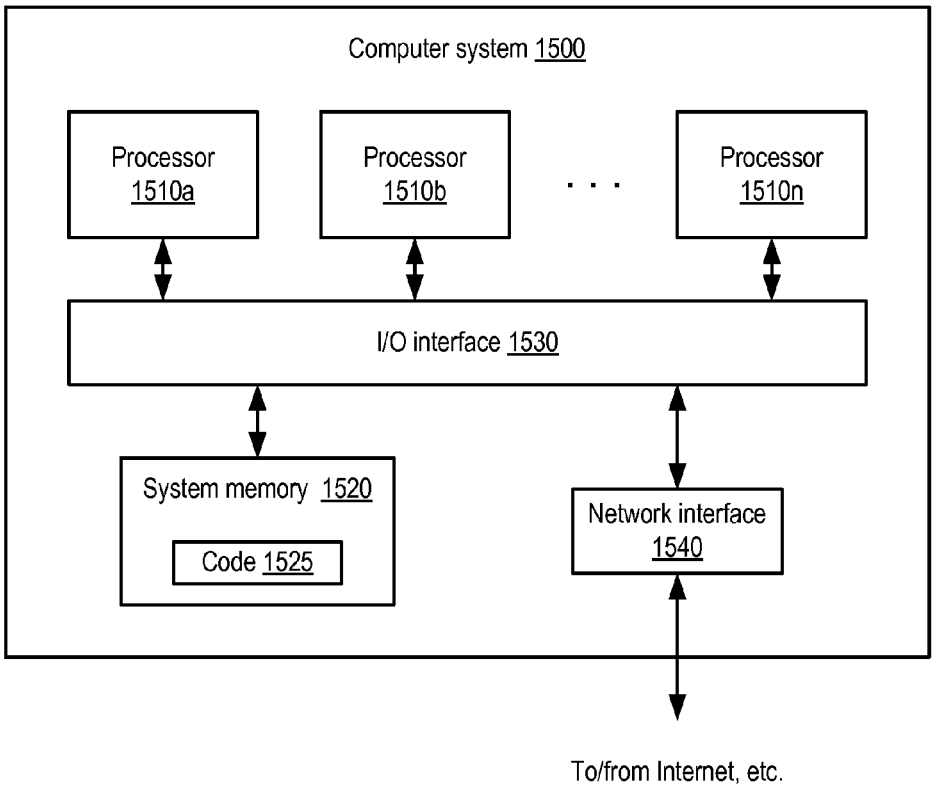
FIG. 15 illustrates a general-purpose computer system that includes or is configured to access one or more computer-accessible media, according to some embodiments.

Users, often described as customers, of a network-based site may peruse items offered on a network-based site through a variety of systems, like those described with regard to FIG. 15, and communication methods, such as communications exchanged over a network. Customers, more generally, may be retailers, online merchants, individuals, suppliers, and/or any other entity that may request display information concerning items offered on a network-based site. Customers may be other network-based sites or enterprises with supply channels or networks, utilizing many different hardware and/or software configurations to communicate with a network-based site. For example, a custom car repair service may maintain a part supply system that communicates with a network-based site to request information on and place orders for specialty car parts offered on a network-based site.

The items offered on a network-based site may be fulfilled by other entities, known as fulfillment networks, including, but not limited to online merchants, wholesalers, manufacturers, retailers, distributers, or any other entity that may receive orders for items stored in inventory, retrieve the ordered items, and ship the items to the ordering customer's destination. Note that in some embodiments a fulfillment network may not be the owner of offered items. For example, a gardening retailer may offer several different species and varieties of plants for sale on a network-based site. When the gardening retailer receives an order for a particular warm-weather plant, it may direct a particular warm-weather nursery that holds the plant in inventory to ship the plant to a customer. The gardening retailer may own the plant and receive the profits from the plant's sale, but the warm-weather nursery may be the gardening retailer's fulfillment network because it receives the order for the warm-weather plant from the gardening retailer, retrieves the plant from inventory, and ships the plant to the customer.

Communications between a fulfillment network and a network-based site may be facilitated through many different communication systems, implemented by many different configurations of hardware and software. Some network-based sites may communicate through private networks or channels to direct orders to fulfillment networks, while others may use public communication channels, such as a network like the Internet or wireless networks, to send communications to and receive communications from fulfillment networks. The content of these communications may be orders for items directed to fulfillment networks and the reminders, directions, and follow-on communications related to an order. Communications may also include information concerning items a fulfillment network offers on the network-based site, such as the item identification numbers, quantity of items, and the logistical information necessary to ship items, such as the shipping origin of the item where a shipping carrier would take custody of the item. Some embodiments may allow a network-based site to receive communication information for new or additional items to be offered on a network-based site from fulfillment networks.

Network-based sites may implement a location-based shipping option, also known as an enhanced shipping option, for customers of a network-based site. An enhanced shipping option may provide one or more shipping services to a customer ordering a particular item that is eligible for the enhanced shipping option. FIG. 1 illustrates an example operating environment for a network-based site that implements determining eligibility for a location-based shipping option for multiple fulfillment networks, according to some embodiments.

Network-based site 110 may obtain requests for display information for items offered on the network-based site from customers, such as Customer A 102, customer B 104, and Customer C 106. In some embodiments, network-based site 110 may be an e-commerce website or other computer network-based retail site. Network-based site 110 may receive from customers requests for display information concerning one or more items offered on the network-based site. In some embodiments the network-based site may receive these requests over a network, such as the depicted network, the Internet 100. The requested display information may be text, images, graphics or otherwise displayable data about a particular item. For example, Customer A 102 may be desktop computer that displays a webpage based upon display information received over the Internet 100 from the network-based site 110. When the network-based site 110 receives the request from Customer A 102, the network-based site 110 may send display information that displays various text and images concerning the item on the webpage. A network-based site 110 may obtain requests from various customers, sending display information in response. A network-based site 110 may obtain requests from Customers A 102, B 104, and C 106 for the same or different items offered on the network-based site 110. A network-based site, such as network-based site 110, may implement various configurations of servers, load balancers, and other hardware/software configurations to handle multiple customers.

One or more fulfillment networks may offer items on a network-based site. One of these fulfillment networks may be controlled by the same entity that controls the network-based site. Some network-based sites may allow at least one other fulfillment network to offer items on the network-based site that are controlled by an entity distinct from the entity controlling the network-based site. For example, in FIG. 1 items may be offered on the network-based site 100 by fulfillment network A 142 which accesses inventory A 132, fulfillment network B 144, which accesses inventory B 134, fulfillment network C 146, which accesses inventory 136, and the entity fulfillment network 130, which accesses inventory 140. The dotted line denotes that a single entity controls both the network-based site 110 and the entity fulfillment network 130. Fulfillment networks A 132, B 134, and C 136 may be operated or controlled by one or more entities distinct from the entity controlling the network-based site 110 and the entity fulfillment network 140. In one example fulfillment network A 142 may be a jewelry artisan, neither owned nor controlled by the network-based site 110. The jewelry artisan may offer several different necklaces for order on network-based site 110. If the network-based site receives a customer order for one of the jewelry artisan's necklaces, then the network-based site 110 may communicate this order to fulfillment network A 142, the jewelry artisan. The jewelry artisan then packages and ships the necklace to the customer and retains the profits of the sale (though in some embodiments a network-based site 110 may share a portion of the profits, usually in the form of a fee). As depicted in FIG. 1, a network-based site, like 110, may offer items from multiple fulfillment networks, such as fulfillment networks A 142, B 144, and C 146. Communication between the network-based site 110 and the fulfillment networks A 142, B 144, and C 146 is depicted using private communication channels, including, but not limited to private networks utilizing hardware/software devices, shared access to inventory management systems, or private communications such as emails, Multimedia Messaging Service (MMS) or Short Messaging Service (SMS) text messages, phone calls, facsimiles, or other physical or digital communications. Although not depicted in FIG. 1, fulfillment networks may utilized public communication channels, such as networks like the Internet 100.

Various embodiments may implement a location-based shipping option, referred to as an enhanced shipping option. This enhanced shipping option may, in some embodiments, be limited to customers who are also subscribers to a subscription-based shipping program. In some embodiments then enhanced based shipping option may be extended to items offered by multiple fulfillment networks of which at least one of the fulfillment networks is not controlled by the entity controlling the network-based site. The network-based site may determine the eligibility of particular items for the enhanced shipping option for particular customers. For example, the network-based site 110 may a receive a request for display information concerning a clock. The clock is fulfilled by fulfillment network A 142. The network-based site 110 may determine, through various means described below, the clock's shipping origin, essentially the location where fulfillment network A 142 would ship the clock from. The network-based site 110 may also determine a predicted shipping destination for the clock for Customer A 102. Based upon the shipping origin and predicted shipping destination, the network-based site 110 may determine the eligibility of the clock for ordering with the enhanced shipping option and return over the Internet 100 (or other network) display information that indicates that the clock is eligible for the enhanced shipping option. If, however, the network-based site 110 were to detect that Customer A 102 has updated its shipping destination, the network-based site 110 may determine that the clock is no longer eligible for the enhanced shipping option, and may send display information configured to reflect the change. The network-based site may obtain a request from Customer B 104 for display information for the same clock viewed by Customer A 102. As Customer B 104 may have a different shipping destination than Customer A 102, the network-based site may determine that the clock is not eligible for the enhanced shipping option for Customer B 104. Yet, the network-based site 110 may also determine that the same model of clock fulfilled by fulfillment network B 144 is eligible for the enhanced shipping option, based option the shipping origin of the clock from fulfillment network B 144.

The previous example illustrates the various combinations of eligibility for items offered on a network-based site for various pairings of customers and fulfillment networks. A network-based site may determine eligibility for offered items in response to various communications from both customers and fulfillment networks. These communications may provide further information obtained by a network-based site to determine or determine again item eligibility for an enhanced shipping options. Further descriptions of these communications as well as various methods for determining eligibility are described below.

Example System Configuration of a Network-Based Site

Figure 2:
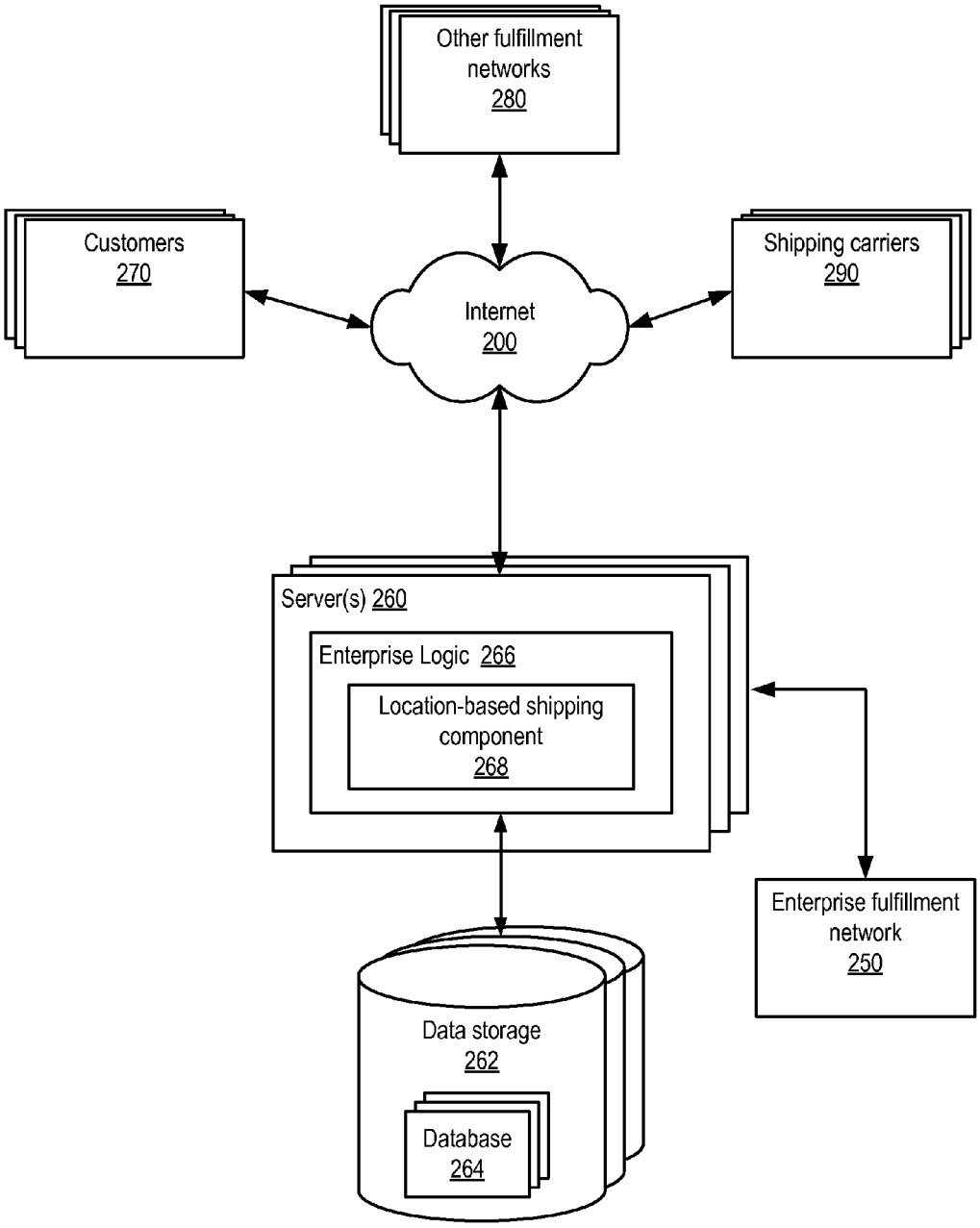
FIG. 2 is a block diagram that illustrates an example system configuration for implementing an embodiment for determining eligibility for a location-based shipping option for multiple fulfillment networks, according to some embodiments.

A network-based site, such as network-based site 110 described in FIG. 1, may be implemented in a variety of ways. A network-based site may need to communicate with a variety of entities, such as fulfillment networks, customers, and other entities, like shipping carriers in order to make item eligibility determinations for an enhanced shipping option and send display information to customers configured to identify eligible items. Therefore, many different configurations of hardware and software, systems, devices, and methods may be envisioned for a network-based site. FIG. 2 is a block diagram that illustrates an example system configuration for a network-based site implementing an embodiment for determining eligibility for a location-based shipping option for fulfillment networks, according to some embodiments.

A network-based site may be implemented on one or more servers 260, one or more of which may be coupled to Internet 200 (or other network, or combination of networks). An example system that may be used for a server 260 is illustrated in FIG. 15. Servers 260 may include software and/or hardware that implements enterprise logic 266 through which the functionalities of the network-based site may be supported, and through which items offered by the network-based site may be ordered according to embodiments as described herein, or via other ordering methods. Enterprise logic 266 may include software and/or hardware that implements location-based shipping component 268 that provides the functionalities of the enhanced shipping option as described herein. Location based shipping component 268 may be a part of shipping management application with may interact with various other components in enterprise logic 266. For example, enterprise logic 266 may implement a subscription management program that allows customers to subscribe to a subscription-based shipping program. The subscription-based shipping program may allow customers to use a location-based shipping option, known as an enhanced shipping option. As part of its eligibility determination, location-based shipping component 268 may interact with this subscription management application to determine whether to include in display information eligibility information for a customer.

Servers 260 may be coupled to data storage 262 for storing information in database 264 related to the network-based site including, but not limited to, webpages, data related to items offered by the network-based site, and customer information, such as, but not limited to, customer billing information and default shipping addresses. Data storage 262 may be implemented as one or more storage devices configured independently or as a storage system. In general, data storage 262 may be implemented as one or more of any type of storage device and/or storage system suitable for storing data used by the server systems of the website including, but not limited to: redundant array of inexpensive disks (RAID) devices, disk drives or arrays of disk drives such as Just a Bunch Of Disks (JBOD), (used to refer to disks that are not configured according to RAID), optical storage devices, tape drives, RAM disks, Storage Area Network (SAN), Network Access Storage (NAS), or combinations thereof.

Database 264 may be implemented as a single, monolithic database or as a combination of two or more databases and/or data stored in other, non-database formats, such as files stored in any of various file formats. Database 264 may be or may include a relational database, or may be or may include any other type of database, such as an object oriented database, depending on implementation, or combinations thereof. In one embodiment, database 264 may include a customer database configured for storing information about customers that have accounts for accessing the network-based website. In one embodiment, database 264 may include a user database for storing information about users that have accounts at the network-based site. The stored user information may include, but is not limited to payment and billing information, a default shipping address, order history, and memberships with network-based site programs, such as a subscription-based shipping program. Other data stored in database 264 may include fulfillment network performance data, such as on-time delivery data and customer feedback. Databases may store the shipping origins for items offered for order on the network-based site, quantities of offered items, and item identification numbers. Shipping performance information may be stored regarding one or more shipping carriers providing delivery times and locations for previous orders. Embodiments may record orders generated by the network-based site in database 264 including shipping information such as shipping labels and shipping tracking identifiers. More generally, data storage 262 may store some or all transactional data received by and sent from a network-based site to customers 270, other fulfillment networks 280, shipping carriers 290, and/or the enterprise fulfillment network 250.

A network-based site may obtain requests from customers, such as requests described with regard to FIG. 1. Enterprise logic 266 implemented on servers 260 may be configured to obtain requests from customers 270. Customer requests, such as requests for display information concerning a particular item offered on the network-based site may travel over a network, such as the Internet 200. In some embodiments, servers 260 may receive requests from customers 270 through a client system (e.g., a computing device such as a desktop computer, laptop computer, tablet computer, smart phone, etc.). Each client system of a customer 270 may be configured to access the network-based site using, for example, a web client application, such as a web browser. Network-based sites may utilize other messaging protocols or networks for messages received from client devices. For example, in some embodiments, a server 260 may configured to receive a SMS or MMS text message requesting display information from a mobile phone of customer 270. In other example embodiments, servers 260 may obtain request messages from a supply management system of a customer 270 which utilizes a server system that sends request messages over a private network (not depicted). Various embodiments may configure servers 260 to obtain customers 270 requests from many different devices using many different communication protocols. For example, a network-based site may provide customers 270 with an Application Programming Interface (API) through which a client system may be configured to communicate with API defined message formats and functionalities to servers 260 and enterprise logic 266.

In one embodiment, servers 260 may allow a customer 270 using a client system access to a network-based site implemented by enterprise logic 266 on servers 260, for example using a web browser. The network-based site may cause to display a webpage of the network-based site on a client system that may include a user interface configured to specify one or more items for display for the customer, and a user interface configured to accept user orders of displayed items. Display information configured and sent by a network-based site to a customer 270 may be configured to display information concerning the specified one or more items on the user interface. Information about an enhanced shipping option or a subscription-based shipping program and/or one or more user interface elements for selecting shipping options may be displayed on the user interface.

A network-based site may send orders to a fulfillment network and receive from a fulfillment network requests to submit additional items for offer on a network-based site, such as the communications described with regard to FIG. 1. Many different hardware and software configurations may be implemented to facilitate these communications. For example, servers 260 may send orders and obtain requests from one or more other fulfillment networks 280 over a network, such as the Internet 200, through a client system (e.g., server, a computing device such as a desktop computer, laptop computer, tablet computer, smart phone, etc.). These fulfillment networks may be controlled by an entity distinct from the entity controlling the network-based site. In some embodiments, servers 260 may allow a client system of an other fulfillment network 280 to access the network-based site using a web client application, such as a web browser. Enterprise logic 266 send orders to other fulfillment network 280 by displaying information through the web application.

In another example, a network-based site may provide another fulfillment network 280 with an API by which servers 260 may allow a client system, such an application implemented on server or other computing device, to access or receive messages from enterprise logic 266. These client servers of other fulfillment networks 280 may be servers that implement websites of other entities, such as enterprises, institutions, or individuals, that control the one or more other fulfillment networks 280, order management applications, or real-time messaging systems. In some embodiments, mobile client devices of other fulfillment networks 280 may access or interpret messages from enterprise logic 266 of servers 260 through mobile applications relying upon APIs or standard mobile technologies, such as SMS or MMS text messages. Many possible implementations exists for facilitating the communication between a network-based site and fulfillment networks which are not described herein so as not to obscure the claimed subject matter and thus none of the above examples are intended to be limiting.

In one embodiment, enterprise logic 266 on servers 260 may allow another fulfillment network 280 using a client system access to the network-based site implemented by enterprise logic 266 on servers 260, for example by using a web browser. The network-based site may cause to display a webpage of the network-based site on a client system that may include a user interface configured to accept submissions of one or more additional items to offer for order on the network-based site. The user interface may display one or more submission user interface elements to obtain information, such as the identification information of items, the quantities of items, and the locations of items. The user interface may be configured to display orders generated by the network-based site for the fulfillment network to fulfill and supply shipping labels and shipping tracking information for the order to the fulfillment network.

A network-based site may control or operate its own fulfillment network for items it offers on the network-based site. In some embodiments the network-based site through enterprise logic 266 on servers 260 may generate orders and send the orders to an entity fulfillment network 250 controlled by the same entity controlling the network-based site. Orders may be communicated through a variety of means, such as over an internal network (e.g., intranet). In some embodiments, enterprise logic 266 and enterprise fulfillment network 250 may both access an inventory management system through which enterprise logic 266 may send orders to enterprise fulfillment network 250 and obtain item information from enterprise fulfillment network 250.

In some embodiments, a network-based site may communicate with shipping carriers to determine item eligibility for an enhanced shipping option. For example, servers 260 implementing enterprise logic 266 may request or obtain information from one or more shipping carriers 290 over a network, such as the Internet 200, through a client system (e.g., a server or other computing device). Shipping carriers may be courier services, package delivery services, postal services, freight services, and more generally, any common carrier, service, company, or mode of transporting an item from one location to another. Enterprise logic 266 may configured to submit information to shipping carriers 290, such as shipping origin, shipping destination, and shipping timeframe information. In some embodiments, servers 260 and client devices of shipping carrier 290 may both access a mutual database or other device that allows either party to store and retrieve information for the other party. Other communication tools may be used, such as an API. For example, a network-based site may obtain an API from shipping carriers 290 allowing enterprise logic 266 to communicate with one or more client devices of shipping carriers 290, such as servers, through an application. This application may be able to provide the network-based site with information used by the location-based shipping component 268 to determine item eligibility for an enhanced shipping option. Location-based shipping component 268 may send a postal code and a one day shipping timeframe to shipping carriers 290 utilizing the API. Location-based shipping component may receive from shipping carriers 290 information data containing a list of five postal codes which the shipping carrier may deliver from the origin postal code within the one day shipping timeframe in addition to the shipping cost. Various embodiments may implement many forms of customized hardware and/or software devices and applications to facilitate communication between shipping carriers 290 and a network-based site through various messaging protocols, APIs, or networks.

Network-based sites may implement a location-based shipping component within the enterprise logic of a network-based site. The various methods and functionalities of a location-based shipping component are described below with respect to FIG. 3 and other related figures. Location-based shipping component 268 may be implemented in a shipping management application within the enterprise logic 266, or separately on a location-based shipping application. Some embodiments may implement dedicated hardware to implement location-based shipping component 268, such as a dedicated server or network of servers. Location-based shipping component 268 may communicate with other applications within the network-based site, such as those that may be implemented with the enterprise logic 266. For example, location-based shipping component may communicate with a fulfillment network application, which determines the performance of fulfillment networks, or a subscription shipping application, which determines which items or customers may be ordered with a subscription-based shipping option.

Sending and Configuring Display Information

Figure 3:
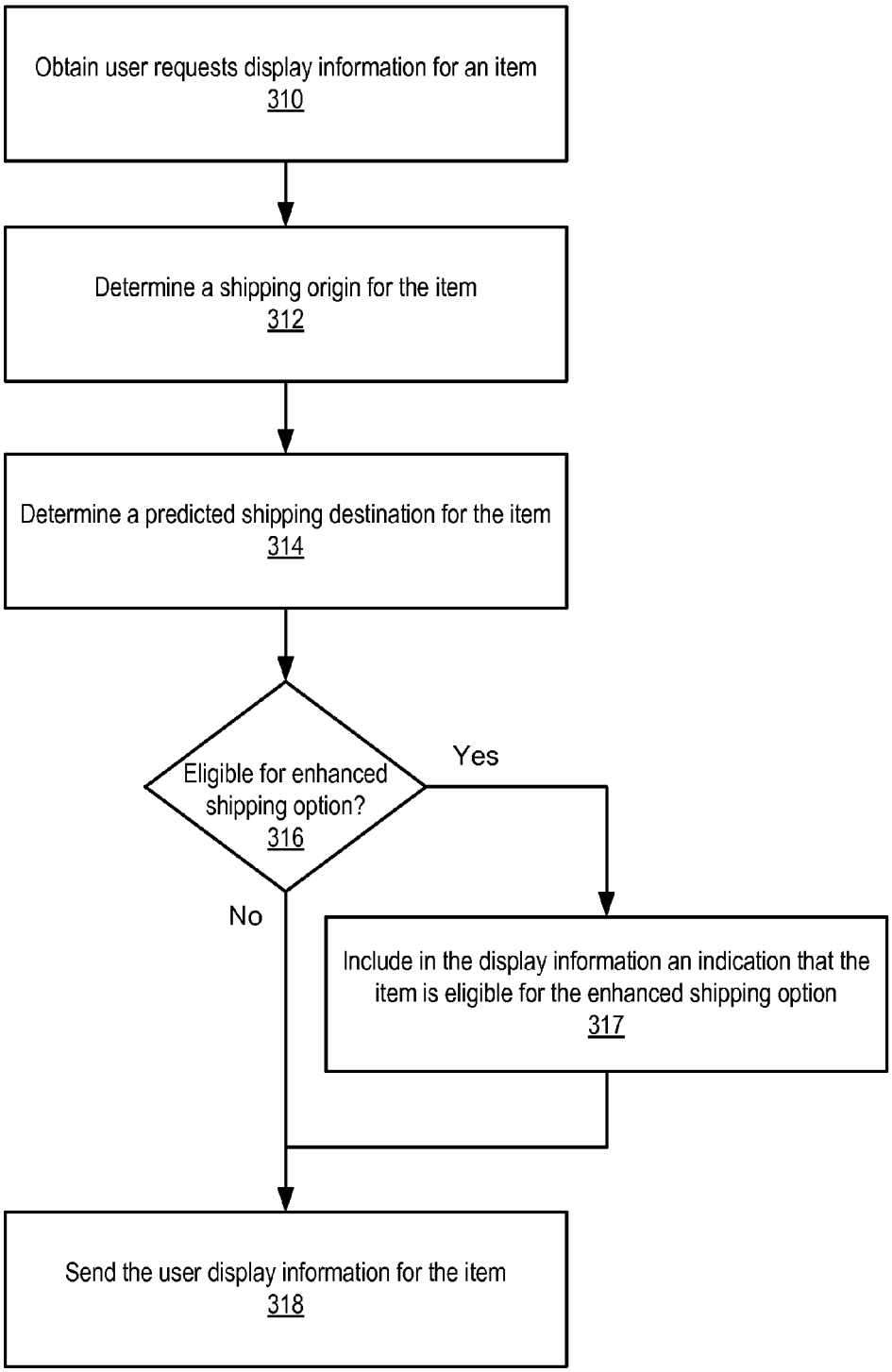
FIG. 3 illustrates a flowchart of an example method for determining eligibility for an enhanced shipping option, according to some embodiments.

As described above, a network-based site, such as network-based site 110 in FIG. 1, may determine whether a particular item offered by a particular fulfillment network is eligible for an enhanced shipping option based on whether the particular item can be shipped from the shipping origin of the item to arrive at the predicted shipping destination of the item within a timeframe specified for the enhanced shipping option using a cost-effective shipping technique. A cost-effective shipping technique may be a shipping technique such as ground shipping that may be a lower cost shipping technique than other shipping techniques, such as air shipping, that can ship the item from the origin to predicted destination within the timeframe for the enhanced shipping option. In some embodiments, a cost-effective shipping technique may be a shipping technique having a shipping cost below a predefined threshold. Network-based site 110 may configure display information indicating eligibility for the particular item to be sent to a particular customer. In describing an example system of a network-based site, FIG. 2 identifies a location-based shipping component that may implement determining whether a particular item offered by a particular fulfillment network is eligible for an enhanced shipping option and configure display information indicating eligibility to be sent to a particular customer. A location-based shipping component may implement various methods to make this determination. FIG. 3 illustrates a flowchart of an example method for determining eligibility for an enhanced shipping option, which may be implemented in some embodiments of a location-based shipping component. As indicated at 310 the network-based site obtains a request for display information for an item. An item is one of the one or more items offered on a network-based site for order by a user. A network-based site may obtain a selection from a user selecting one or more of the offered items and requesting display information for the selected items. Display information may include, but is not limited to text information (e.g., item description, price, condition, etc.), images or videos of the item, and any other graphical data that may be displayed concerning an item. In some embodiments, display information may be configured for display in a user interface, such as described below with respect to FIGS. 4 and 5.

In some embodiments offered items may be fulfilled by two or more fulfillment networks, such as those described in FIGS. 1 and 2. One fulfillment network may be controlled by the entity controlling the network-based site. At least one other fulfillment network may be controlled by an entity distinct from the network-based site. Display information may contain information about the respective fulfillment network offering the item. Further information about the fulfillment network may be displayed for users, or may available upon further user request.

Prior to a user selecting a particular one of the items offered by the network-based site, embodiments may determine a shipping origin for the item, as indicated at 312. Various embodiments may implement various methods to determine the shipping origin of the item. In some embodiments, a network-based site may access data storage that stores item information such as the shipping origin of the item. For example, a handbag seller may offer various handbags on a network-based site. When placing the offers for the handbags on the network-based site, the handbag seller may provide the network-based site with information about each handbag, such as size, color, weight, condition, and the location of the handbag. A network-based site may store all of the information concerning each handbag in a database. To determine the shipping origin of the handbag, the network-based site need only access the item location information in the database.

In some embodiments, an item may be stored in more than one location, even when offered by only one fulfillment network. For example, a book publisher may warehouse its inventory in two different locations in the United States, one on the west coast and one on the east coast. Both warehouses may contain quantities of the same book. A network-based site may take into account the locations of both warehouses when determining eligibility for an enhanced shipping option for the book. To account for the possibility of one fulfillment network offering an item that may have more than one shipping origin, some embodiments will determine eligibility for each of the shipping origins for the item for each fulfillment network if the display information of more than one fulfillment network offering the item is requested by a user. Using the above example, if the network-based site obtains a request for display information concerning the above book, a location-based shipping component may make two eligibility determinations for the book. First, the west coast warehouse location may be used as the shipping origin in method described below with regard to element 316 which determines item eligibility for an enhanced shipping option based upon the shipping origin and the predicted shipping destination of an item. Second, the east coast warehouse location may be used as the shipping origin in the method described below with regard to element 316 which determines item eligibility for an enhanced shipping option based on whether the item can be shipped by the different entity from the shipping origin to arrive at the predicted shipping destination within a timeframe specified for the enhanced shipping option using a cost-effective shipping technique or at a shipping cost below a predefined threshold. If either warehouse location used provides an eligible item, then the display information concerning the book for the requesting user will indicate that the book is eligible for the enhanced shipping option.

Figure 4:
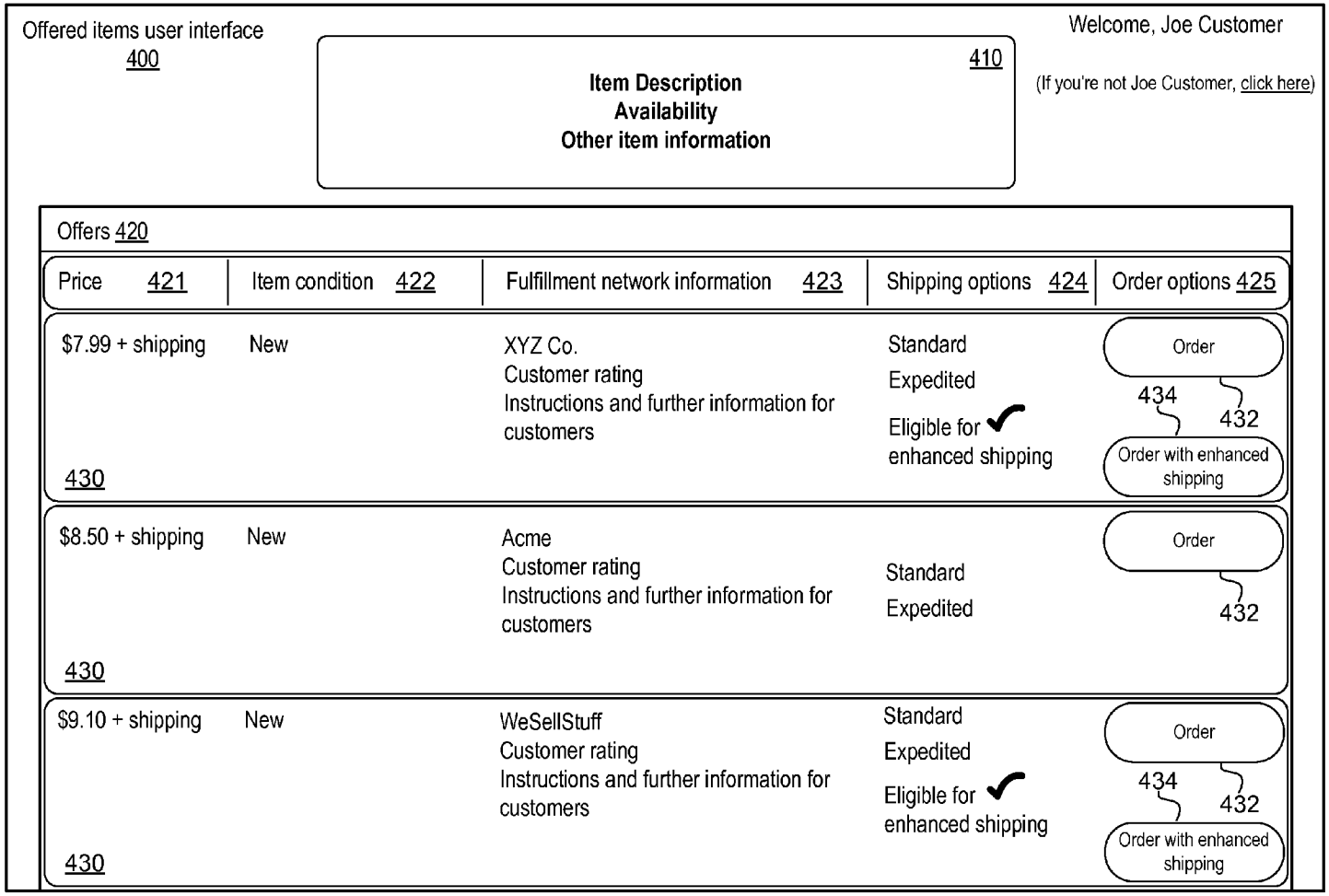
FIG. 4 illustrates an example embodiment of display information that provides a user interface configured to accept a user order for a particular item offered by multiple fulfillment networks, according to some embodiments.
Figure 5:
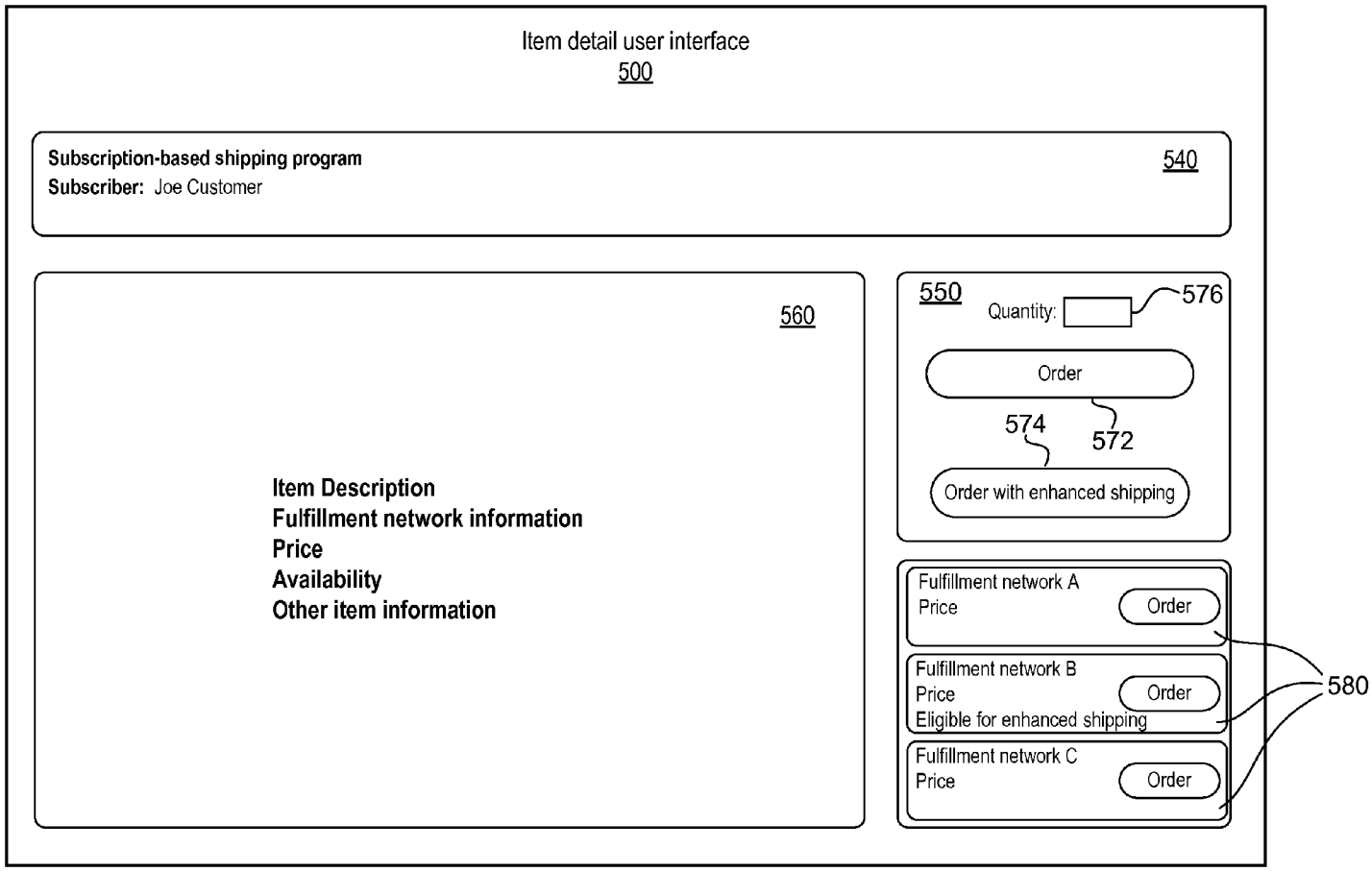
FIG. 5 illustrates an example embodiment of display information that provides a user interface configured to accept a user order for a particular item, according to some embodiments.
Figure 6:
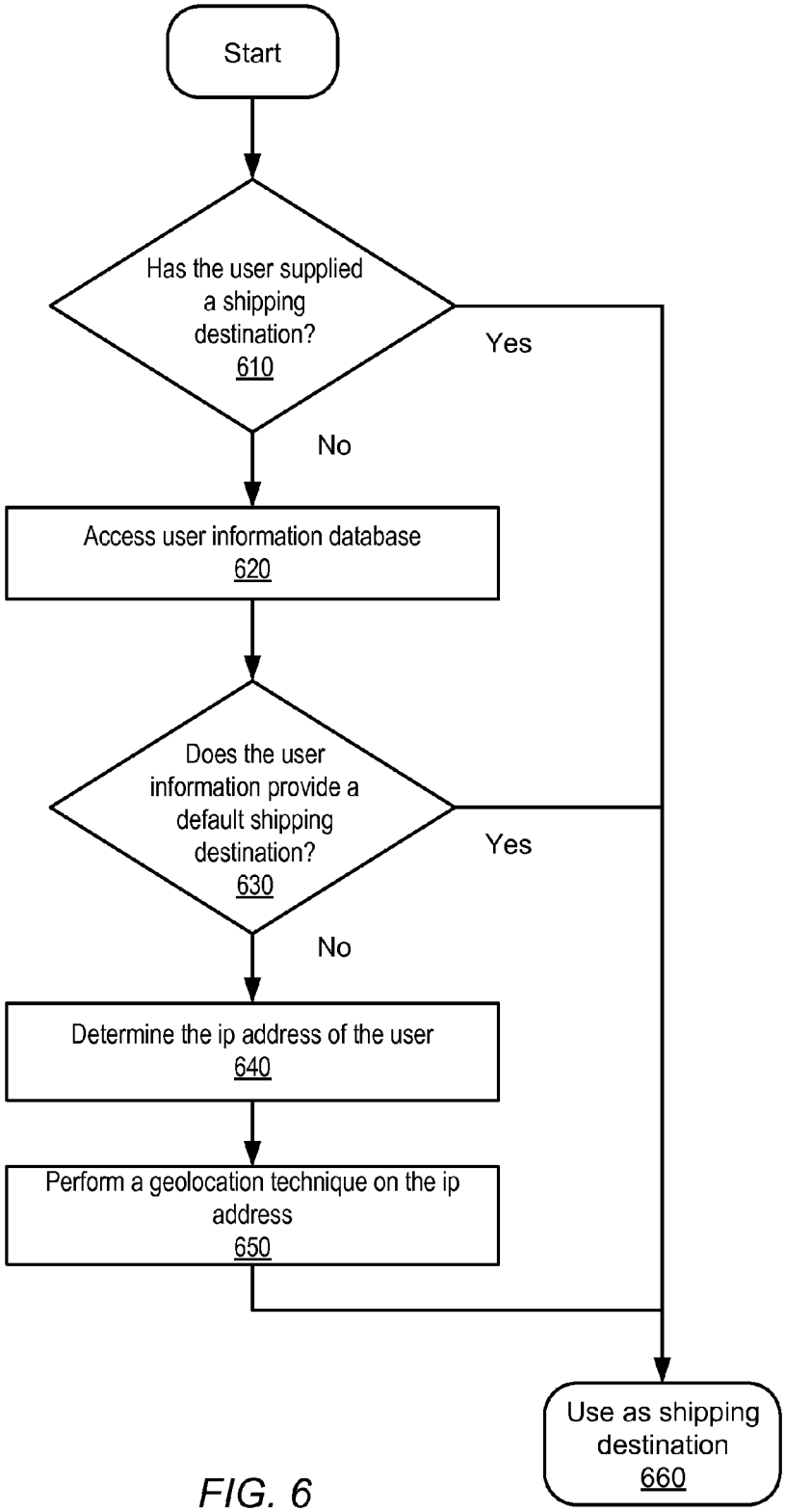
FIG. 6 illustrates a flowchart of a method to determine a predicted shipping destination, according to some embodiments.

Embodiments may then determine a predicted shipping destination 314 for the item according to various embodiments. The discussion below with regard to FIG. 6 provides some the many possible embodiments to determine a predicted shipping destination. In many of these embodiments the shipping origin, determined at 312, and the predicted shipping destination, determined at 314, are used to determine if one or more shipping carriers could deliver the item within a certain delivery timeframe. More implementation detail, as well as some of the possible embodiments, are further explained below at FIG. 6. If the item is determined eligible for the enhanced shipping option 316 using one of the various methods to determine item eligibility, then included in the display information sent to the user is an indication that the item is eligible for the enhanced shipping option 317. An indication may be a graphic symbol, text, or image. FIGS. 4 and 5 described below illustrate possible embodiments of display information configured to indicate that an item is eligible for the enhanced shipping option.

Embodiments may then, in response to the user request 310, send the display information for the item to the user 318. The discussion above with regard to FIGS. 1 and 2 describe the various communication methods by which a network-based site may send the display information to a client system of a user. In one example, a network-based site may obtain a MMS or SMS text message from a user, requesting display information 310 for an item. After determining the shipping origin 312, determining a predicted shipping destination 314, and determining whether the item is eligible for an enhanced shipping option 316, a network-based site may send the user a MMS text message that includes an item image, description, price, and words indicating that the item is available to order with the enhanced shipping option.

In some embodiments the display information sent to a user 318 for an item may be configured as a user interface. The user interface may display item offers from multiple fulfillment networks. FIG. 4 illustrates an example embodiment of display information that provides a user interface configured to accept a user order for a particular item offered by multiple fulfillment networks. The offered items user interface 400 may include one or more user interface elements, such as buttons, tabs menus, etc., through which the user may navigate to other pages on the interface and/or perform other functions, such as searches. In some embodiments the offer items user interface 400 displays bar, stripes or areas 430 displaying multiple fulfillment networks that may offer the same item 410. These fulfillment networks may be operated or controlled by an entity distinct from the entity controlling the network-based site, such as fulfillment networks A 142, B 144, and C146 discussed and described in FIG. 1. For each fulfillment network display, a network based site may determine the eligibility of the fulfillment network's item for the enhanced shipping option according to a method, such as the method outlined in FIG. 3.

Item area 410 may display information concerning the item, such as graphic images, video, text descriptions and other item information, which may be obtained by enterprise logic 266 accessing data storage 262 in FIG. 2 Offers for the item may be displayed in an offer area 420, which also may be determined by an enterprise logic 266 accessing data storage 262 in FIG. 2. This area may contain information about the specific offers for the item such as price 421, item condition 422, fulfillment network information 423, available shipping options 424, and order options 425. These categories may be expanded to include more or less information about offers. User interface element 434 is a marker, identifying the offer as eligible for a subscriber shipping program. This marker is an example of the enhanced shipping option eligibility identification included in the display information at 317 in FIG. 3. Selecting the "Order with enhanced shipping option" 434 may allow a user to order the item with the enhanced shipping option, generating the order for shipping with the enhanced shipping option, discussed with regard to element 914 in FIG. 9 below, and sending the order to the corresponding fulfillment network using the various methods described with regard to other fulfillment networks 280 in FIG. 2. In some embodiments, the "Order with the enhanced shipping option" element may be a single-action user interface element that initiates an order for the item using previously supplied user information. Varying information about the shipping program as well as a hyperlink leading to user interface elements that display further information may also be displayed. The "Order" user interface element 432 may allow a user to select an item for order. In some embodiments, selecting the "Order" user interface element may allow the user to add the item shown on the interface to a collection, or cart, of items that the user may purchase when done selecting items.

In some embodiments the display information sent to a user 318 for an item may be configured as a user interface may display item offers from one fulfillment network. FIG. 5 illustrates an example embodiment of display information that provides a user interface configured to accept a user order for a particular item, according to some embodiments. Through item detail user interface 500 a user may view information about an item and order (or pre-order, if the item is not yet available) the item according to one or more shipping options offered by the shipping program, if desired, according to one embodiment. Item detail user interface 500 may include one or more user interface elements, such as buttons, tabs menus, etc., through which the subscriber may navigate to other pages on the website and/or perform other functions, such as searches. User information area 540 may describe user account information and display messages or other information to the user, which may be obtained by the enterprise logic 266 accessing a database containing user information 264 as described above with regard to FIG. 2. For example, in FIG. 5 the user is described as a subscriber to a shipping-based subscription program and the user's name is given, "Joe Customer." In another example, user information area 540 may be displayed to include one or more options available only to subscribers of a subscription-based shipping program and specific to this item detail user interface, as determined by a subscription-based shipping application implemented in enterprise logic 266 in FIG. 2 accessing a subscriber database 264. Area 540 may also display a predicted shipping address, such as determined at 314 in FIG. 3, or a default shipping address for the user, which may be determined by enterprise logic 266 in FIG. 2 accessing a user database 264 that contains a default shipping address.

Item detail area 560 may describe relevant graphical and/or textual information about the item associated with this item detail webpage, such as an item description, price, availability of the item, and other item information such as a picture of the item, which may be obtained by enterprise logic 266 accessing data storage 262 in FIG. 2. User interface area 550 may include one or more user interface elements for selecting standard options of the network-based website, such as an "Order" button 572 that allows the user to add the item shown on the webpage to a collection, or cart, of items that the user may purchase when done selecting items. User interface element 574 is a marker, identifying the offer as eligible for an enhanced shipping option. This marker is an example of the enhanced shipping option eligibility identification included in the display information at 317 in FIG. 3. Selecting the "Order with enhanced shipping option" button 574 may allow a user to order the item with the enhanced shipping option, generating the order for shipping with the enhanced shipping option, discussed with regard to element 914 in FIG. 9 below, and sending the order to the corresponding fulfillment network using the various methods described with regard to other fulfillment networks 280 in FIG. 2. In some embodiments, the "Order with the enhanced shipping option" element may be a single-action user interface element that initiates an order for the item using previously supplied user information. Area 550 may also include a user interface element 576, such as a pop-up menu or text box, through which the user may select a quantity for the item, if ordered.

FIGS. 4 and 5 are described above as examples of possible implementations of display information sent by a network-based site to a user, such as described at 318 in FIG. 3, where the display information is one or more user interfaces configured to accept orders for one or more items offered by a network-based site. The examples described above are merely two of many possible embodiments of display information and are not intended to be limiting. Many other configurations or user interfaces implemented to accept orders for one or more items offered by a network-based site are envisioned, but not described, so as not to obscure the claimed subject matter.

Determining a Predicted Shipping Destination

Network-based sites may determine the eligibility of items fulfilled by one or more fulfillment networks for an enhanced shipping option. In various embodiments, the shipping origin of an item, as determined at 312 in FIG. 3, and a predicted shipping destination for the item, as indicated at 314 in FIG. 3, are used by embodiments to determine a predicted shipping destination. Many embodiments, discussed below with regard to FIGS. 7*a* through 7C, use the shipping origin, the predicted shipping destination, and a shipping delivery timeframe to make an eligibility determination, as indicated at 316 in FIG. 3. Some of the possible methods of determining a predicted shipping destination are outlined in FIG. 6.

FIG. 6 illustrates a flowchart of a method to determine a predicted shipping destination according to some embodiments. The various methods outlined in FIG. 6 may be implemented as part of an application or component implementing the method described in FIG. 3, which in turn may be implemented by a shipping program application or location-based shipping component, such as the location-based shipping component 268 described in FIG. 2. As indicated at 610, a location-based shipping component may obtain a shipping destination from a user sent to a network-based site prior to or along with requests for display information concerning offered items. For example, a network-based site may obtain from a user certain information before allowing the user to access the network based site, such as name, billing information, and shipping address. Similarly, in another example this information may be obtained from a user before a network-based site will send display information to a user. Embodiments may provide various user interfaces or message formats to obtain this information. In one example, the user interfaces in FIGS. 4 and 5 may be configured to provide various user interface elements that obtain a shipping destination. In response to a user supplied shipping destination, the network-based site will use the supplied shipping destination as the predicted shipping destination for determining whether an item is eligible for an enhanced shipping option for the requesting user.

If the network-based site has not obtained a user shipping destination, some embodiments may access user information stored in a database, such as database 264 in FIG. 2. Generally, a user may supply user credentials to associate the user with a particular user account on the network-based site. For example, before receiving a request for display information concerning a particular item, a network-based site may have previously received user credentials associating the user with a particular user account (e.g., providing a user access to a sign-on webpage). When the network-based site sends display information to the identified user, the default shipping address of the account may considered as the predicted user shipping address. In another example, a network-based site may define a message protocol that requires client devices to provide user information in one of the fields of request, response, or acknowledgement messages sent to a network-based site. When a network-based site receives a request for display information using the above protocol, the network-based site will be able to retrieve any user associated data, such as a default shipping address from a user database, such as the database 264 in FIG. 2. User information, including, but not limited to a default shipping address or billing address may be stored generally in data storage, such as 262 in FIG. 2, or in a particular database, such as 264 in FIG. 2. Other user account information associated with an identified user that is stored in a database may be utilized to provide a predicted shipping destination. For example, an identified user may wish to order a particular item on the network-based site. Located in the user's account order history, stored in a database, previous orders of a similar item may have been sent to a particular destination for the user. A location-based shipping component may count item description keywords, (e.g., "textbook"). If a certain percentage of these items (e.g., 90%) with the same keyword are shipped to an address different from than a user default address, the shipping component may determine the predicted shipping destination for any requested items with the keyword "textbook" to be sent to the address for other "textbook" items in the order history. Therefore, if the user information provides a default shipping destination 630, or other destination information may be determined based upon the user information, embodiments may use one of these addresses, selected by the location-based shipping component, as the predicted shipping destination 660.

Some embodiments may determine the internet protocol (IP) address of the user 640. Many techniques well-known to those of ordinary skill in the art exist to allow a network-based site, or servers implementing a network-based site, to obtain the internet protocol addresses of obtained user requests. After identifying the input internet protocol address, some embodiments may perform a geolocation technique upon the identified internet protocol address 650. A geolocation technique receives as input an internet protocol address and identifies the geographical location of the user of the identified internet protocol address. Common may geolocation services, such as WHOIS, may automatically trace an internet protocol address and return such information as country, region, city, postal/zip code, latitude, longitude and time zone. The amount of information retrieved may be dependent upon the geolocation service and/or the entity utilizing the internet protocol address. For example, some internet protocol addresses for individuals may be only identifiable as to the physical address of their internet service provider. Various embodiments may implement geolocation services controlled by the entity controlling the network-based site, such as implementing their own hardware and/or software to implement a geolocation technique, or separate services from a third-party provider. After performing the geolocation technique to determine a ip address location, some embodiments may use the ip address location as the predicted shipping address 660.

Embodiments may implement various combinations of the elements described in FIG. 6. Some embodiments may use only one predicted shipping determination method. Other embodiments may combine them in various combinations or orders different than described in FIG. 6. FIG. 6 is not intended to be limiting as to a particular order or combination of methods to determine a predicted shipping destination.

In some embodiments, a client device or system may be a mobile phone or other mobile computing device, such as client device 270 discussed above with regard to FIG. 2. Embodiments may determine a predicted shipping destination based on the geographic area from which the mobile device accessed the network-based site. A predicted shipping destination as provided to a shipping carrier may be a geographic area, such as city, county, or list of postal codes. Various implementations may be utilized to determine the geographic area of a mobile device. Some mobile devices may be identified through the Global Positioning Satellite (GPS) network, or other various forms of the network such as Assisted GPS (A-GPS). In some embodiments, the communication channel may determine the geographic area of a mobile device. For instance, if a mobile device is accessing a cellular network, a cellular triangulation technique may be used to determine the geographic area of the cellular network accessing mobile device. In another example, a mobile device may be accessing a wireless network connected to a wide area network (WAN), such as the Internet, which the geographic area may be determined by the particular wireless access point used, or the ip geolocation technique discussed above at 650. The above examples are some of many possible location techniques for a mobile device and are not intended to be limiting.

In some embodiments, the location information of a mobile device may be directly available to a network-based site. For example, if a mobile device is using a custom software application developed to interact with the network-based site, it might relay the geographic area of the mobile device as determined by one of the previously discussed techniques for determining the geographic area of a mobile device. In some embodiments, the network-site may be able to determine through a third party service or application that directed the mobile device to the network-based site. For example, if a mobile device used a location application or search engine with location determining capabilities that redirects a mobile device to the network-based site, the location application or search engine may provide information about the mobile device geographic area to the network-based site when directing the mobile device there.

Some embodiments may obtain a request from a user to modify the predicted shipping destination. This request may be obtained over one of the communication methods, systems, or devices described with respect to customers 270 in FIG. 2. In response, embodiments may determine whether the particular item selected is eligible for the enhanced shipping option based on the shipping origin and the modified predicted shipping destination, using a method such as outlined with regard to FIG. 3. Some embodiments may include in display information sent to the user an indication that the particular item is no longer eligible for the enhanced shipping option. This display indication may take a form similar to the indication used for eligible items. In some embodiments, the display information is configured to identify eligible items without providing any indication or notification of a change in item eligibility.

For example, a customer, such as a customer described in FIG. 1, may through a client system request display information for teddy bear. The customer has an account with the network-based site that has a default shipping address associated with the customer. After receiving the display information, the customer notices a display element on which identifies the shipping destination as the customer's default shipping destination. The customer desires to send the item to another address as a gift and so selects to change the shipping destination by using the client device. The network-based site obtains the customer's modified shipping address and in response determines again the eligibility of the teddy bear for the enhanced shipping option. The teddy bear is no longer eligible and display information is configured and sent to the customer providing a message that states that the teddy bear is no longer eligible for the enhanced shipping option due to the changed address. The above example is one of many possible embodiments that account for a network-based site obtaining a modification of a shipping destination for an item and is not intended to be limiting.

Determining Item Eligibility for an Enhanced Shipping Option

FIG. 3, discussed above, outlines an embodiment of a method to determine whether an item is eligible for an enhanced shipping option. As indicated at 316, embodiments may determine whether an item is eligible for an enhanced shipping option based upon the shipping origin, determined at 312, and the predicted shipping destination, determined at 314 and discussed with regard to FIG. 6 above. Many embodiments, discussed below with regard to FIGS. 7*a* through 7C, use the shipping origin, the predicted shipping destination, and a shipping delivery timeframe to make an eligibility determination, and a shipping cost, as indicated at 316 in FIG. 3.

A location-based shipping component, such as location-based shipping component 268 in FIG. 2, may implement the various eligibility methods described below through various hardware and software configurations. The location-based shipping component may communicate with various shipping carriers, such as shipping carriers 290 in FIG. 2, using the various public and private communication channels previously discussed. As discussed above, shipping carriers may be courier services, package delivery services, postal services, freight services, and more generally, any service, company, or mode of transporting an item from one location to another.

In some embodiments, eligibility may be determined by determining one or more shipping timeframes according to one or more shipping carriers based upon the shipping origin and the shipping destination. A shipping timeframe may be the door-to-door delivery time from the shipping origin to the shipping destination. A location-based shipping component may determine the shipping timeframe according to various service agreements or expectations. For example, a network-based site may advertise or assert that items ordered with an enhanced shipping option will arrive "the next day." When performing eligibility determinations a location-based shipping component will in the above example submit a delivery timeframe that delivers items in one day. Some embodiments may determine the delivery timeframe according to a subscription-based shipping program. For example, a subscription-based shipping program provides two day shipping for eligible items with no shipping charge (other than the subscription fee). The location-based shipping component determines the delivery timeframe for eligible items to be within two days, as the enhanced shipping option is a shipping option for subscribers. In some embodiments the delivery timeframe may be the estimated and/or guaranteed delivery date of an item.

Along with receiving, calculating, or determining a shipping timeframe, embodiments may determine a shipping cost for the shipping time frame in accordance with the shipping carrier discussed below in FIGS. 7*a*, 7*b*, and 7*c*. Embodiments may determine if the shipping cost of the item shipped from the shipping origin to the predicted shipping destination is below a predefined threshold. A predefined threshold, such as particular dollar amount, may be determined in accordance with the subscription-based shipping program or enhanced shipping option policies at the network-based site. Embodiments may determine whether the item can be shipped from the shipping origin to the predicted shipping destination using a cost-effective shipping technique. A cost-effective shipping technique may be a shipping technique such as ground shipping that may be a lower cost shipping technique than other shipping techniques, such as air shipping, that can ship the item from the origin to predicted destination within the timeframe for the enhanced shipping option. In some embodiments, the shipping timeframes determined may be timeframes for a shipping carrier using a ground shipping service. For example, a service level agreement for the subscription-based shipping program may specify a 2-day delivery time. To determine if an item is eligible for the enhanced shipping option, the system may determine whether the item can be shipped from the origin to the destination within the required 2-day timeframe using ground shipping. For example, if the shipping origin and destination are within a region such that a cheaper shipping methodology (e.g., ground shipping) may be used, then the item may be eligible for the enhanced shipping option. However, if the shipping origin and destination are located such that a more expensive shipping methodology (e.g., air freight) would be required to meet the 2-day timeframe, then the item may be deemed ineligible for the enhanced shipping option.

Figures 7A, 7B, 7C:
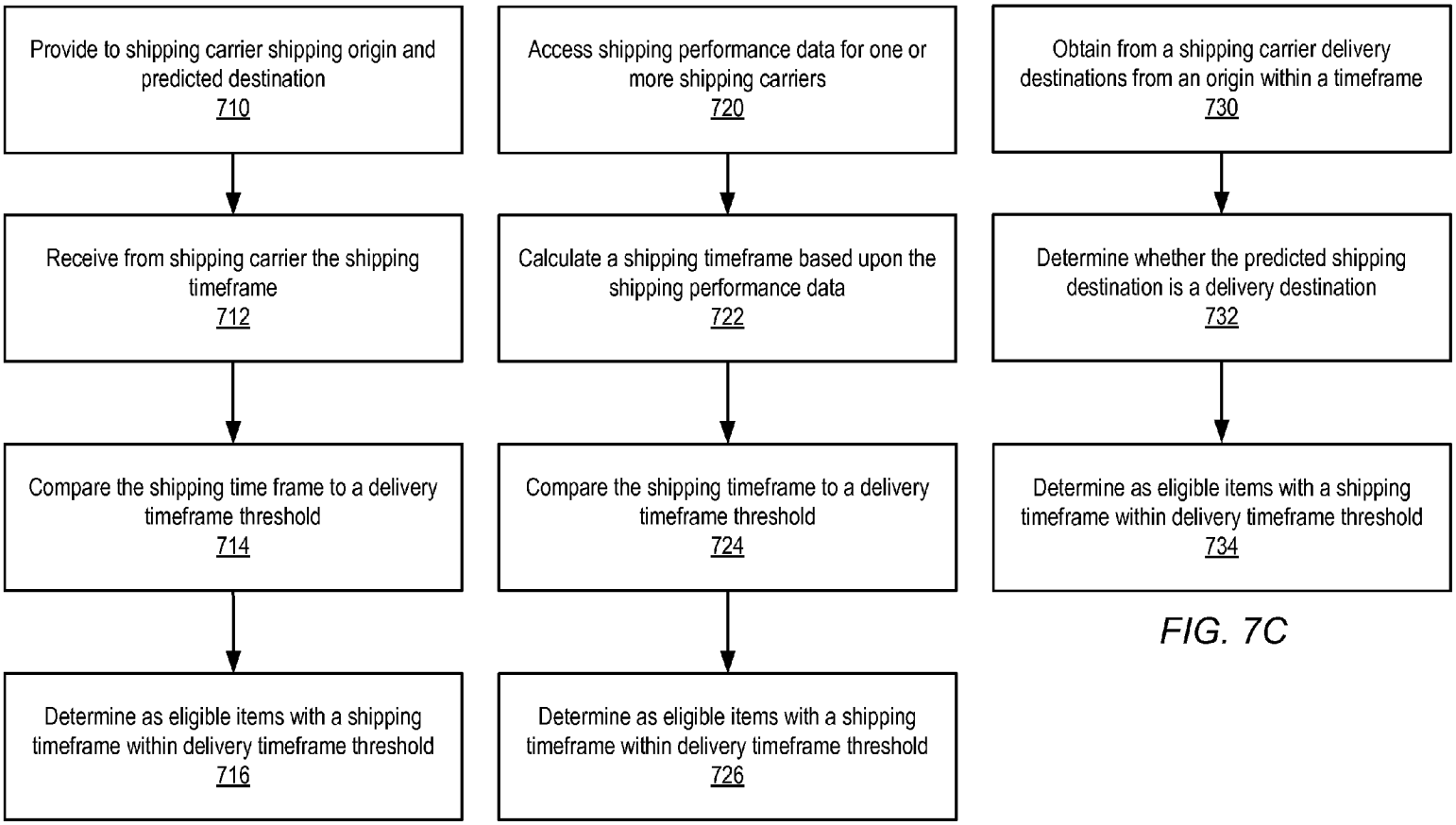
FIG. 7A illustrates a workflow of a method to determine, based upon the shipping origin and the predicted shipping destination, whether an item is eligible for an enhanced shipping option, according to some embodiments.
FIG. 7B illustrates a workflow of a method to determine, based upon accessing shipping performance data, whether an item is eligible for an enhanced shipping option, according to some embodiments.
FIG. 7C illustrates a workflow of a method to determine, based upon a shipping origin, whether an item is eligible for an enhanced shipping option, according to some embodiments.

FIG. 7A illustrates a workflow of a method to determine, based upon the shipping origin, the predicted shipping destination, and availability of a cost-effective shipping technique for shipping from the shipping origin to the predicted shipping destination, whether an item is eligible for an enhanced shipping option, according to some embodiments. A network-based site may provide to one or more shipping carriers the shipping origin and the predicted shipping destination of an item 710, communicating with the shipping carriers through the various communication channels discussed with regard to shipping carriers 290 in FIG. 2. For example, the location-based shipping component may generate request messages containing the shipping origin, predicted shipping destination, and the delivery timeframe according to an API that interacts directly with shipping carrier servers. A location-based shipping component may then receive from the one or more shipping carriers the shipping timeframe for that shipping carrier to deliver the item from the shipping origin to the predicted shipping destination 712 using a cost-effective shipping technique. As in the above example, the received shipping timeframe may be obtained according to an API which the location-based shipping program implements through various software and/or hardware mechanisms to communicate with the shipping carrier. Some embodiments may interact with shipping carriers through public communication channels, such as a public shipping carrier website to obtain a delivery timeframe. Embodiments may also access another device, such as a database that a shipping carrier may also access in order to obtain a delivery timeframe.

A location-based shipping component may then compare the received shipping timeframes to a delivery timeframe threshold 714. Some embodiments may query multiple shipping carriers, while other embodiments may query only one shipping carrier. A location-based shipping based shipping component may query shipping carriers based upon pre-established relationships between the network-based site and the shipping carrier. In some embodiments, a location-based shipping component may access a database of shipping carrier performance data for items order on the network-based site, such as a database 264 in FIG. 2, to determine a single carrier that may perform the best for delivering items against some performance measure. For example, a network-based site may store delivery information for items delivered in a specific country. Shipping carrier performance data for that country may indicate that the local government postal service delivers to more locations faster than any other shipping carrier at a lower cost. A location-based shipping component may select to query only the local government postal service for a delivery timeframe.

For items that have a shipping timeframe that is within the delivery time frame threshold using a cost-effective shipping technique, the item is eligible for the enhanced shipping option 716, and identified in the display information at 317 in FIG. 3.

A network-based site may implement more than one method to determine the eligibility of an item for an enhanced shipping option according to the shipping origin and the shipping destination. In some embodiments, a location based shipping component may obtain shipping performance data from a database, such as database 264 in FIG. 2, to determine item eligibility. FIG. 7B illustrates a workflow of a method to determine, based upon accessing shipping performance data whether an item is eligible for an enhanced shipping option according to some embodiments. Embodiments may access shipping performance data for one or more shipping carriers 720 as stored in a database accessible to a network-based site, such as database 264 in FIG. 2. Embodiments may then calculate a shipping timeframe based upon the shipping performance data 722 for a particular cost-effective shipping technique or methodology, such as ground shipping. Such a calculation may determine the historic delivery times for different carriers from the shipping origin to a shipping region that includes the predicted shipping destination using the cost-effective shipping technique. For example, the database may contain information that demonstrates that orders sent from one postal code to another set of postal codes may arrive on a certain day or time using ground shipping. Embodiments may then compare the received shipping timeframes to a delivery timeframe threshold 724. A delivery timeframe threshold may be determined according to one or more service guidelines for an enhanced shipping option. For example, there may be a one day or two day guideline. A delivery timeframe threshold may be determined by a subscription-based shipping program, if the enhanced shipping option is part of the subscription-based shipping program. Some embodiments may obtain multiple timeframes from multiple shipping carriers. For items that have a shipping timeframe that is within the delivery time frame threshold for the cost-effective shipping technique, the item is eligible for the enhanced shipping option 726, and identified in the display information at 317 in FIG. 3.

A network-based site may implement more than one embodiment using information obtained from a shipping carrier, such as those shipping carriers described above. A location-based shipping component may only communicate a shipping origin and a delivery timeframe to a shipping carrier. FIG. 7C illustrates a workflow of a method to determine, based upon a shipping origin and the cost of shipping from the shipping origin to the predicted shipping destination, whether an item is eligible for an enhanced shipping option, according to some embodiments. Some embodiments may obtain from a shipping carrier delivery destinations that the shipping carrier may deliver to within a certain timeframe 730 using a particular cost-effective shipping technique or below a certain shipping cost, having previously submitted to the shipping carrier a shipping origin for the item and shipping cost information, using communication channels described above with regard to shipping carriers 290 in FIG. 2 and above For example, a network-based site may receive from a shipping carrier a list of postal codes that the carrier may deliver to using ground shipping, from another postal code within one day. If the predicted shipping destination is included within or one of the delivery destinations 732, then the item is determined as eligible for the enhanced shipping option 734, and identified in the display information at 317 in FIG. 3.

Figure 8:
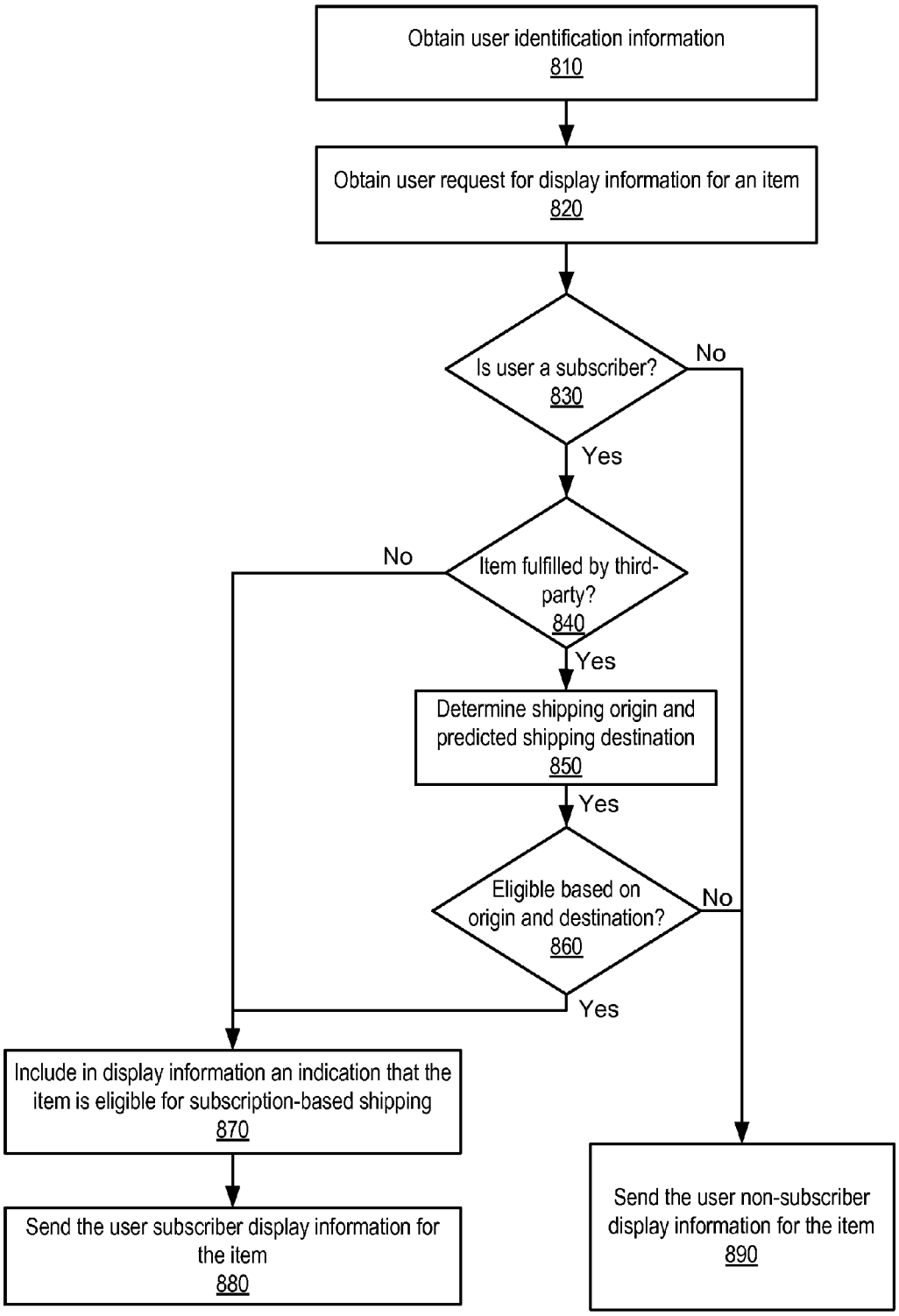
FIG. 8 illustrates a workflow of a method to determine the eligibility of an item for subscription-based shipping for multiple fulfillment networks, according to some embodiments.

Determining Subscription-Based Shipping Eligibility for Multiple Fulfillment Networks A network-based site may, in various embodiments, offer items fulfilled by multiple fulfillment networks for order on the network-based site, such as the fulfillment networks described with regard to FIG. 1. Moreover, in some embodiments a customer, such as described in FIG. 1, may also be a subscriber and eligible for certain enhanced shipping options as part of a subscription-based shipping program. Some embodiments provide a method for determining whether an item is eligible for subscription-based shipping for multiple fulfillment networks, when at least one of the multiple fulfillment networks is controlled by an entity distinct from the entity controlling the network-based site. FIG. 8 illustrates a workflow of a method to determine the eligibility of an item for subscription-based shipping for multiple fulfillment networks. A network-based site may obtain input at a network-based site identifying a user 810. User identification information may be included in a request for display information or obtained separately at the network-based site. The user identification may include a name and password, id and pin number, or any combination of identification information that allows the network-based site to identify the user. The user may access a user interface to provide the identification information to the network-based site. As indicated at 820, a network-based site may request display information for one or more items selectable for order on the network base site by multiple fulfillment networks. One of the fulfillment networks may be controlled by the entity that controls the network-based site, such as describe with regard to FIG. 1. At least one other of the fulfillment networks may be controlled by an entity distinct from the entity controlling the network-based site.

Based upon the input identifying the user, some embodiments may determine whether the user is a current subscriber to a subscription-based shipping program 830. Such a determination, may, in some embodiments, be made by accessing the user information stored on a subscription database, such as database 264 in FIG. 2, to identify whether the user has a current subscription to a subscription-based shipping program. If the user is not a subscriber, then the network-based site may send the user non-subscriber display information for the item 890. This display information may only differ from subscriber display information based upon the shipping options displayed to the user.

Embodiments may then obtain input at the network-based site specifying one or more items for display for the subscriber. Some embodiments may allow a user to access a user interface, such as, but not limited to, a webpage, configured to accept user orders of the displayed one or more items. If the item is fulfilled by a fulfillment network controlled by an entity distinct from the entity controlling the network-based site 840, then the network-based site determines the shipping origin and the predicted shipping destination of the item 850. Otherwise, include in the display information sent to the user an indication that the item is eligible for subscription-based shipping program 870 and send the display information for the item to the user 880. If the item is determined to be eligible for the subscription-based shipping program 860, according to a method such as the method described with regard to FIG. 3, then include in the display information sent to the user an indication that the item is eligible for subscription-based shipping program 870 and send the display information for the item to the user 880. If the item is determined to be ineligible for the subscription-based shipping program 860, send the user non-subscriber display information for the item 890.

Generating an Order with the Enhanced Shipping Option

Figure 9:
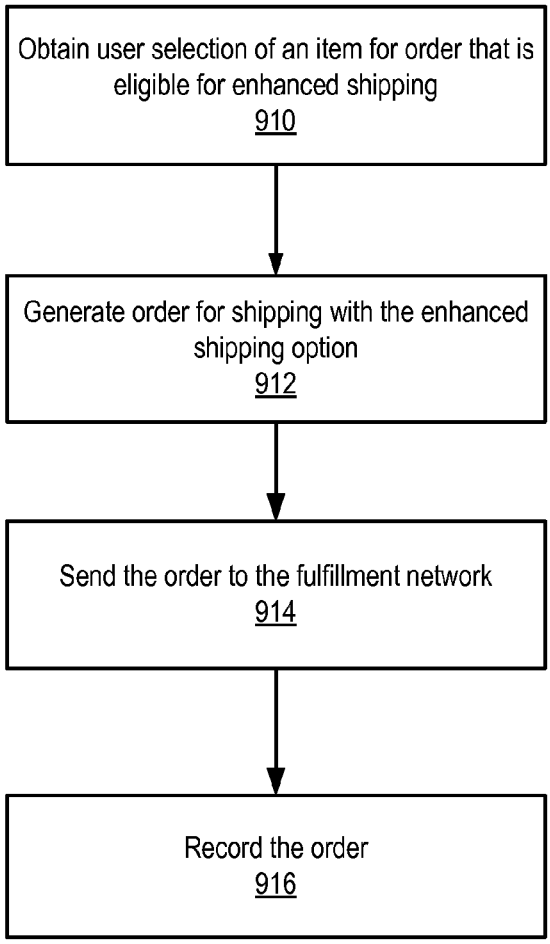
FIG. 9 illustrates a flowchart for a method to generate an order with the enhanced shipping option, according to some embodiments.

A network-based site may obtain orders for items identified as eligible for an enhanced shipping option. A location-based shipping component, such as location-based shipping component 268 in FIG. 2, may implement various software and/or hard components to generate orders for items, send item orders, and record orders in a database, such as database 264 in FIG. 2, or communicate with various other components of the enterprise logic 266 of FIG. 2 to generate orders for items, send item orders, and record orders in a database. FIG. 9 illustrates a flowchart for a method to generate an order with the enhanced shipping option, according to some embodiments.

Various embodiments may obtain input at the network-based site selecting at least one of the displayed one or more items that the user wants to order 910. In at least some embodiments a user may access a user interface configure to accept orders of the displayed one or more items, such as described above with regard to FIGS. 4 and 5. For example, a server, such as servers 260 in FIG. 2, may obtain a customer selection sent over a wireless network from the customer's web-enabled mobile phone to order an item offered at the network-based site that is eligible for enhanced shipping. The selection is obtained through a webpage provided to the customer and through the selection of an "Order with enhanced shipping" button which communicates the selection to the network-based site.

In response to obtaining input selecting at least one of the displayed one or more items that the user wants to order, a location-based shipping component or enterprise logic may generate an order for the selected at least one item directing the at least one item to be a shipped according to the enhanced shipping option 912. To generate an order various embodiments may communicate with a shipping carrier, such as a shipping carrier 290 in FIG. 2, to obtain a shipping label and shipping tracking identifier. For example, location-based shipping component or enterprise logic may communicate through a software application configured according to a particular shipping carrier's API that allows the network-based site to create a shipment and receive a shipping label and shipping tracking identifier for the shipping carrier. An order may also include item information, such as item identification information, the quantity of the item ordered, the shipping option selected, a shipping label, and/or a shipping tracking number for a particular carrier. Embodiments may use the shipping carrier that provided that was used to determine the item was eligible for the enhanced shipping option.

Embodiments may then send the generated order to the corresponding fulfillment network for the ordered item 914 using one the communication channels discussed with the other fulfillment networks 280 in FIG. 2 and formatting the order and any accompanying information in a format suitable to the communication channel (e.g., document format for a facsimile, multiple messages for SMS or MMS text messages, hyperlinks for access to a website, etc.). For example, enterprise logic or a location-based shipping option may be configured to send an email with the order and accompanying shipping information, such as the shipping label and shipping tracking identifier, to the corresponding fulfillment network. The email may provide links that allow the fulfillment network to access the shipping carrier's website or system to provide further shipping instructions and print the shipping labels. Other embodiments may send the order to the corresponding fulfillment by providing the corresponding fulfillment network access to a user interface configured to retrieve order information, such as described below with respect to FIG. 10.

In some embodiments the network-based site may record the order 916 in a database, such as a database 264 in FIG. 2, including in the record, but not limited to, the shipping tracking identifier and the corresponding order fulfillment network. Some embodiments may use the record to determine the delivery time of an item, described below with regard to FIG. 11, and to determine the performance of fulfillment networks, described below with regard to FIG. 12.

In some embodiments, a network-based site may provide a fulfillment network with access to a user interface configured to manage orders sent to the fulfillment network, as indicated at 914 in FIG. 9. FIG. 10 illustrates an exemplary manage order user interface, via which a fulfillment network may access to manage item orders, according to one embodiment, but is not intended to be limiting. Some embodiments may allow a fulfillment network to manage orders sent to a fulfillment network via a manage order user interface 1000. Note that sent orders may be sent to the fulfillment network through some other communication channel in addition to the user interface, for example in an email. In some embodiments a fulfillment network may search for particular orders in an order search list element 1010 by providing a search type 1011, such as whether the order is regular or expedited, search range 1012, such as dates or times order was received, and a search user interface element 1013, which instructs the user interface to obtain the search results. These user interface elements may be configured by enterprise logic to access various databases, such as described in data storage 262 in FIG. 2, to retrieve the various orders corresponding to the fulfillment network. As described above with regard to FIG. 2, the databases may implement various relational associations or other logic to aid the enterprise logic to satisfy order search requests on manage order user interface 1000.

The order search results area 1020 displays order information, such as, but not limited to, order date 1021, order identification 1022, shipping destination 1023, shipping option 1024, order status 1025, and action 1026. Such fields may be supplied with information obtained by the enterprise logic accessing a database, such as database 264 in FIG. 2. Embodiments may provide additional user interface functionality in the order action field, such as retrieving and/or printing order shipping labels and order tracking information. In some embodiments, the action field may provide a hyperlink to a shipping carrier, where a fulfillment network may obtain and/or print a shipping label and shipping tracking identifier.

Determining Item Delivery Time within a Delivery Timeframe

Figure 11:
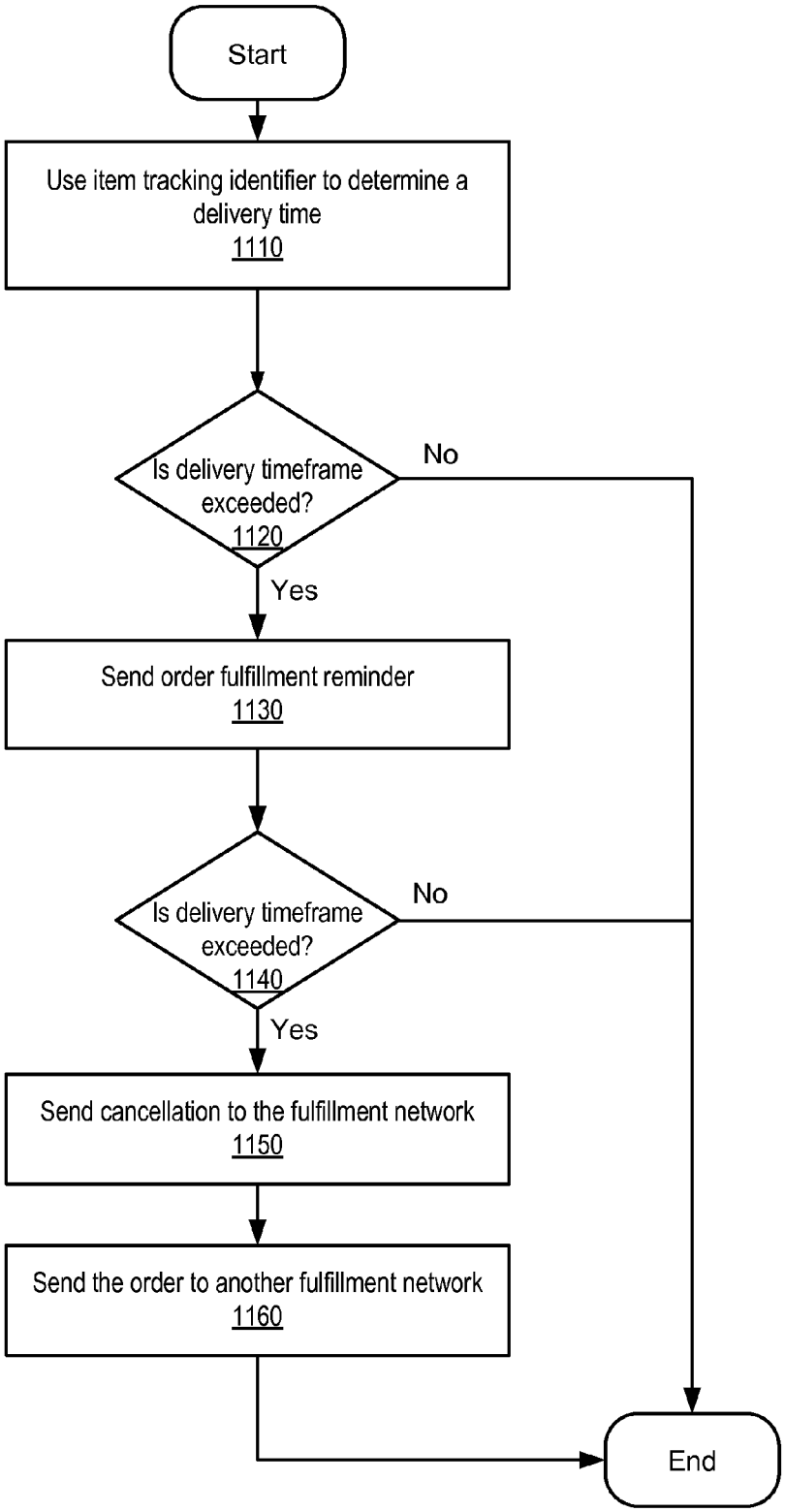
FIG. 11 illustrates a flowchart of a method to determine the delivery time of an item within a delivery timeframe, according to some embodiments.

A network-based site that allows multiple fulfillment networks to offer items that may be eligible for an enhanced shipping option, such as the fulfillment networks described with regard to FIG. 1, may implement various mechanisms to determine whether a fulfillment network is performing according to the network-based site's enhanced shipping expectations. A location-based shipping component may access the recorded order information, as indicated in 916 in FIG. 9, stored in a database, such as database 264 in FIG. 2, to determine the delivery time of ordered items. Many different determinations and actions may be implemented by a location-based shipping component in response to accessing recorded shipping information. FIG. 11 illustrates a flowchart of a method to determine the delivery time of an item within a delivery timeframe, according to some embodiments.

A location-based shipping component may access an item's shipping tracking identifier for a particular order that is recorded on an order database, such as database 264 in FIG. 2. A location-based shipping component may use the shipping tracking identifier to determine the delivery time of an item. In some embodiments a location-based shipping component may communicate with a shipping carrier, such as a shipping carrier 290 in FIG. 2, to obtain the delivery time of an item corresponding to that shipping carrier's tracking identifier for the item. For example, location-based shipping component or enterprise logic may communicate through a software application configured according to a particular shipping carrier's API that allows a location-based shipping option to utilize a software and/or hardware component configured to according the API to submit the tracking identifier for the item to the corresponding shipping carrier. The location-based shipping component may obtain from the shipping carrier the estimated or actual delivery time of the item to the customer. Alternatively, in some examples, the shipping-based component may be configured to receive delivery message updates (e.g., item picked up, item left shipping facility, item out for delivery, item delivered) from the shipping carrier concerning an item according to the item's shipping tracking identifier. The location-based shipping component may record these message updates in the order database corresponding to the fulfillment network. Neither of the two examples described above is intended to be limiting as to the many possible implementations of obtaining a delivery time from shipping carrier that may be envisioned by those of ordinary skill in the art.

A location-based shipping component may determine whether a delivery timeframe is exceeded 1120 by comparing the determined delivery time 1110 to a delivery timeframe. The delivery timeframe, as described above, may be the door-to-door delivery time from the shipping origin to the shipping destination. A location-based shipping component may determine the delivery timeframe according to various service agreements or expectations. Some embodiments may determine the delivery timeframe according to a subscription-based shipping program. For example, a subscription-based shipping program provides two day shipping for eligible items with no shipping charge (other than the subscription fee). Embodiments may also use the same timeframe as was used to originally determine the order's eligibility for the enhanced shipping option, as indicated at 316 in FIG. 3. For example, if an order's eligibility was determined according to a two day shipping delivery timeframe, then the location-based shipping component will determine the delivery timeframe to be within two days. In some embodiments, the determined delivery time may not be available. For example, the shipping carrier may have not picked up the package from the fulfillment network. In such embodiments, a location-based shipping program may automatically determine that the delivery time exceeds the delivery time frame. The frequency of the occurrence of the above scenario may depend upon when the location-based shipping option implements the method described in FIG. 11. Some embodiments may determine certain audit times which a location-based shipping component may implement FIG. 11's method to assess the performance of a fulfillment network or to maintain customer expectations concerning the enhanced shipping option.

If the delivery time is found by the location-based shipping component to exceed the delivery timeframe, some embodiments may initiate a corrective action. Various corrective actions may be implemented by a location-based shipping component. In some embodiments, a corrective action may be to send the fulfillment network an order reminder 1130 through various communication methods, such as email, MMS or SMS text message, or phone call, or any other communication channel as described with regard to other fulfillment networks 280 in FIG. 2. For example, if a fulfillment network has not yet handed over an ordered item to a shipping carrier and the location-based shipping component determines the delivery timeframe is exceeded, the location-based shipping component may send both a text message and an email informing to the fulfillment network to ship the order.

Some embodiments may then again determine whether the delivery time frame has been exceeded 1140 using the shipping tracking identifier of the item, such as described above at 1120. For some embodiments, another corrective action may be to send a cancellation order for the item to the fulfillment network 1150, using one of the various communication channels described for other fulfillment networks 280 in FIG. 2. A location-based shipping component may then send the order to another fulfillment network 1160, which may be another fulfillment network controlled by an entity distinct form the entity controlling the network-based site or the entity fulfillment network, such as indicated at 140 in FIG. 1.

Various embodiments may implement a variety of combinations of the elements described in the above method. Individual actions or groups of actions may be implemented in some embodiments. FIG. 11 is not intended to be limiting as to the arrangement or combination of these actions.

Fulfillment Network Performance

Figure 12:
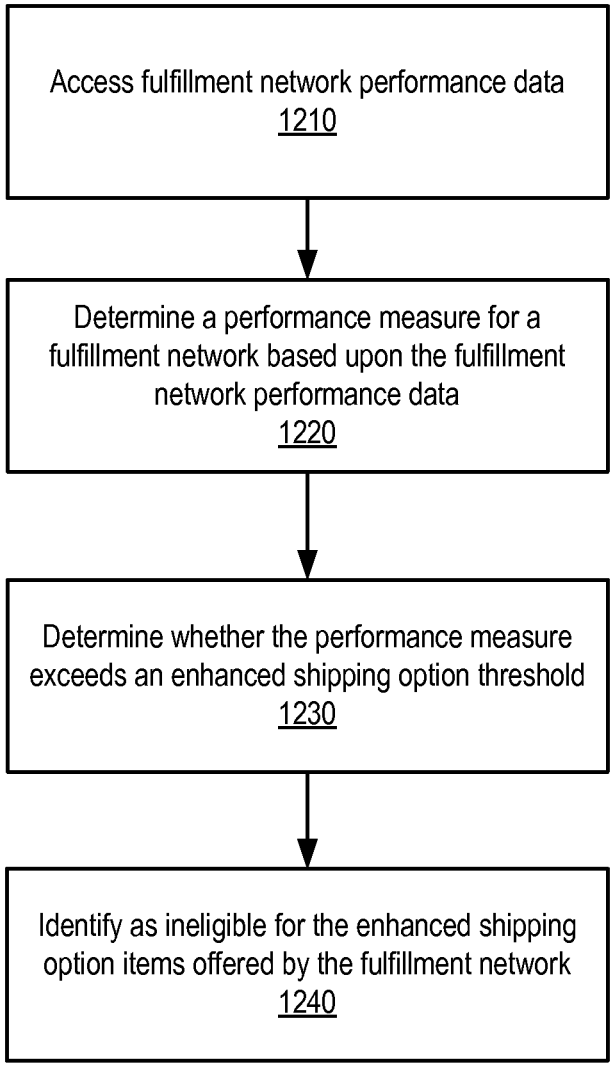
FIG. 12 illustrates a flowchart of a method to evaluate a fulfillment network, according to some embodiments.

As discussed previously, a network-based site that allows multiple fulfillment networks to offer items that may be eligible for an enhanced shipping option, such as the fulfillment networks described with regard to FIG. 1, may implement various mechanisms to determine whether a fulfillment network is performing according to the network-based site's enhanced shipping expectations. In some embodiments, the network-based site may implement a method to evaluate the performance of fulfillment networks according to performance over a period of time or more than a single transaction, as is describe above with respect to FIG. 11. In at least some embodiments, the fulfillment networks evaluated will be those who offer items eligible for the enhanced shipping option. FIG. 12 illustrates a flowchart of a method to evaluate a fulfillment network, according to some embodiments.

A location-based shipping component may access fulfillment network performance data 1210 for a fulfillment network store in a database, such as database 264 in FIG. 2. In some embodiments this data may include, but is not limited to, the previous orders fulfilled by a fulfillment network, customer feedback for orders (e.g., feedback that states "Item was late," "Item was not delivered when promised"), number of on-time deliveries, and number of late deliveries. The location-based shipping component may, based upon this performance data, determine a performance measure for the fulfillment network 1220. For example, a performance measure may be an on-time delivery percentage calculated by dividing the number of on-time deliveries by the total number of delivered orders. It will be apparent to those of ordinary skill in the art that many performance measures may be determined, and the above example is not intended to be limiting.

A location-based shipping component may then determine whether the determined performance measure exceeds an enhanced shipping option threshold 1230 or guideline for participation by the fulfillment network in the enhanced shipping program. Such a threshold or guideline may be determined by an agreement between fulfillment networks and the network-based site. For example, a fulfillment network may, in order to participate in an enhanced shipping option program, agree that it must maintain above 90% deliveries for items fulfilled by the fulfillment network with the enhanced shipping option. Various embodiments may implement various actions depending on the discrepancy between the performance measurement of a fulfillment network and the enhanced shipping option threshold. In some embodiments, if the performance measure exceeds the enhanced shipping option threshold, then all items of the fulfillment network are identified as ineligible for the enhanced shipping option 1240. A location-based shipping component may access a fulfillment network eligibility database, such as database 264 in FIG. 2, to record or retrieve the eligibility of a particular fulfillment network. Some embodiments will configure additional display information to be sent to a user to reflect items determined as ineligible for enhanced shipping option if the fulfillment network becomes ineligible after the display information is sent to a user.

Fulfillment Networks Submission of Additional Items

Figure 13:
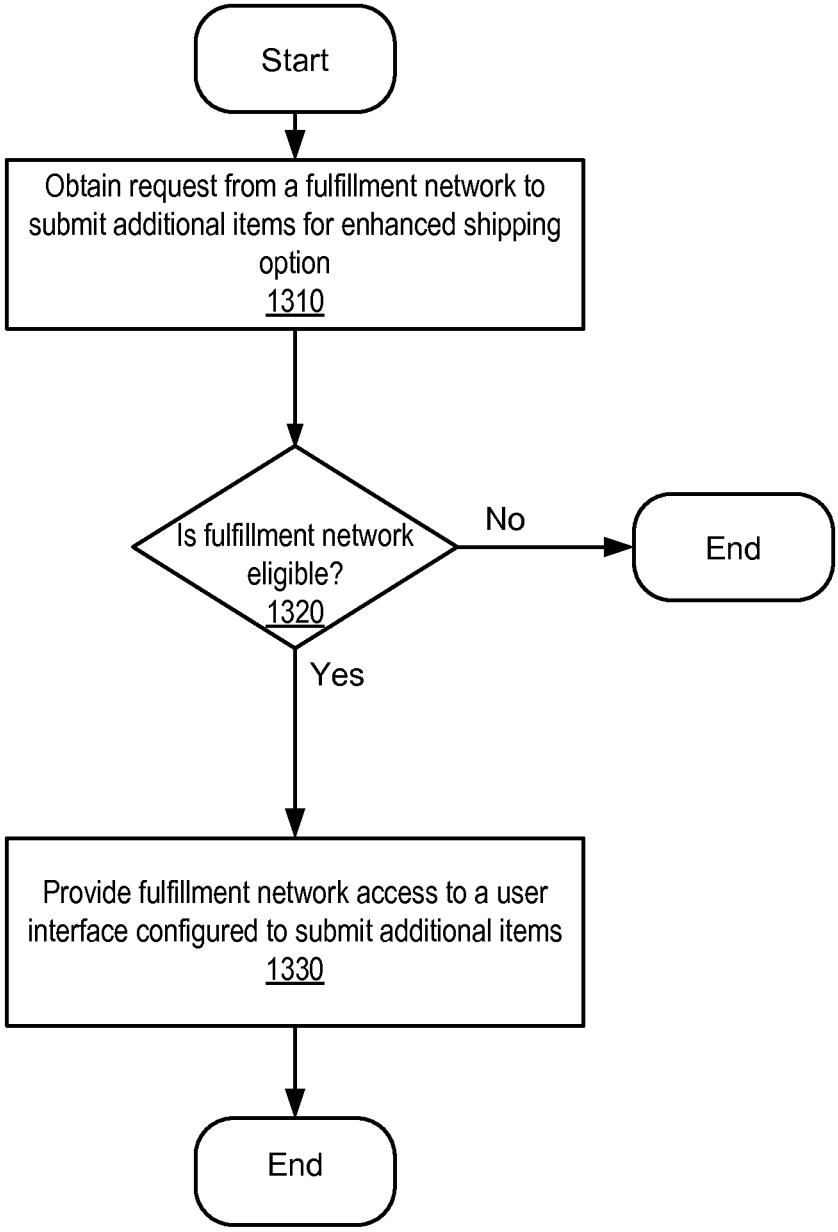
FIG. 13 illustrates a flowchart of a method to submit additional items for offer at the network-based site for the enhanced shipping option, according to some embodiments.

In some embodiments, a network-based site may obtain a request from a fulfillment network submitting one or more additional items to offer for order on the network-based site. A location-based shipping component may obtain such a request over a communication channel described with respect to other fulfillment networks 280 in FIG. 2. FIG. 13 illustrates a flowchart of a method to submit additional items for offer at the network-based site for the enhanced shipping option. A location-based shipping component may obtain a request from a fulfillment network to submit additional items for the enhanced shipping option 1310. In some embodiments this request may be obtained through a user interface, such as described below with regard to FIG. 14. Other embodiments may utilize other communication methods. For example, a location-based shipping component to obtain fulfillment network requests through a network-based site provided web-service API, which may allow fulfillment network systems to communicate with the location-based shipping component. In response to received requests, a location-based shipping component may determine if the fulfillment network is eligible to offer items with the enhanced shipping option 1320, such as by using a method described by above with regard to FIG. 12. If the fulfillment network is determined eligible, the location-based shipping component may provide the fulfillment network with access to a user interface configured to submit additional items for offer with the enhanced shipping option 1330.

A network-based site may, in some embodiments, provide a user interface displays a plurality of submission user interface elements. These submission user interface elements may be configured to obtain identification numbers of the one or more additional items, quantities of the one or more additional items, and shipping origin locations of the one or more additional items. The identification numbers may be unique to the network-based site, or a globally unique id, such as an ISBN. The quantities of the items are the quantity of the item at the submitted location. The location information for items may be the location where a shipping item may be picked up by a shipping carrier or may be the location where an item is stored. For example, an artist may store certain artwork items offered at a studio, but may submit the location of art gallery that handles the shipping and packing as the location. In another example a manufacturer may warehouse finished items offered at the network-based site at many different warehouses around the country. In some embodiments the same item may be in multiple locations. A fulfillment network may submit the item for each shipping origin location of the item, providing the quantity of the item at the location, as well as the item identification information.

Figure 14:
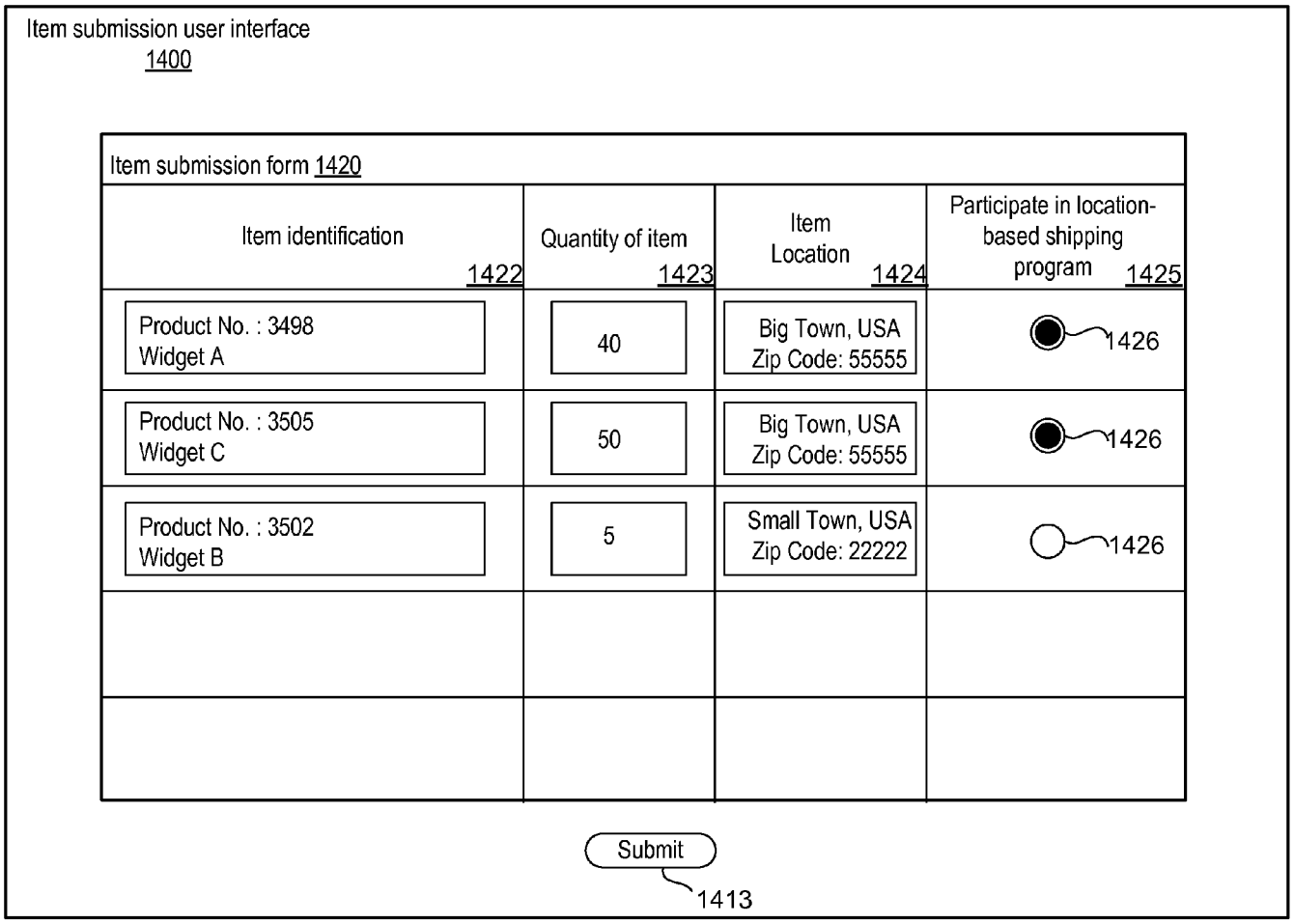
FIG. 14 illustrates an example item submission user interface configured to submit additional items for offer with the enhanced shipping option, according to some embodiments.

FIG. 14 illustrates an example item submission user interface configured to submit additional items for offer with the enhanced shipping option, according to some embodiments. Embodiments may allow a fulfillment network to access an item submission user interface 1400. Item submission form 1420 may provide various user interface elements, allowing a fulfillment network to provide item identification information 1422, item quantity information 1423, item location information 1424, and an option to participate in a subscriber-based shipping program 1425. A fulfillment network may enter various item information into the user interface elements to provide this information. User interface elements 1426 may allow a fulfillment network to select participation in a subscription-based shipping program for a particular item. The "Submit" user interface element 1413 may allow a fulfillment network to provide the information entered to the location-based shipping component. The location-based shipping component may store the item information in an item database, such as database 264 in FIG. 2.

Example System

In one embodiment, a network-based site that implements determining eligibility for a location-based shipping option for multiple fulfillment networks as described herein in FIGS. 1 through 14 may include a general-purpose computer system that includes or is configured to access one or more computer-accessible media, such as computer system 1500 illustrated in FIG. 15. In the illustrated embodiment, computer system 1500 includes one or more processors 1510 coupled to a system memory 1520 via an input/output (I/O) interface 1530. Computer system 1500 further includes a network interface 1540 coupled to I/O interface 1530.

In various embodiments, computer system 1500 may be a uniprocessor system including one processor 1510, or a multiprocessor system including several processors 1510 (e.g., two, four, eight, or another suitable number). Processors 1510 may be any suitable processors capable of executing instructions. For example, in various embodiments, processors 1510 may be general-purpose or embedded processors implementing any of a variety of instruction set architectures (ISAs), such as the x86, PowerPC, SPARC, or MIPS ISAs, or any other suitable ISA. In multiprocessor systems, each of processors 1510 may commonly, but not necessarily, implement the same ISA.

System memory 1520 may be configured to store instructions and data accessible by processor(s) 1510. In various embodiments, system memory 1520 may be implemented using any suitable memory technology, such as static random access memory (SRAM), synchronous dynamic RAM (SDRAM), nonvolatile/Flash-type memory, or any other type of memory. In the illustrated embodiment, program instructions and data implementing desired functions, such as those methods and techniques described above for an network-based website of an electronic commerce enterprise that implements a subscription-based shipping program, are shown stored within system memory 1520 as code 1525.

In one embodiment, I/O interface 1530 may be configured to coordinate I/O traffic between processor 1510, system memory 1520, and any peripheral devices in the device, including network interface 1540 or other peripheral interfaces. In some embodiments, I/O interface 1530 may perform any necessary protocol, timing or other data transformations to convert data signals from one component (e.g., system memory 1520) into a format suitable for use by another component (e.g., processor 1510). In some embodiments, I/O interface 1530 may include support for devices attached through various types of peripheral buses, such as a variant of the Peripheral Component Interconnect (PCI) bus standard or the Universal Serial Bus (USB) standard, for example. In some embodiments, the function of I/O interface 1530 may be split into two or more separate components, such as a north bridge and a south bridge, for example. Also, in some embodiments some or all of the functionality of I/O interface 1530, such as an interface to system memory 1520, may be incorporated directly into processor 1510.

Network interface 1540 may be configured to allow data to be exchanged between computer system 1500 and other devices attached to a network, such as other computer systems, for example. In particular, network interface 1540 may be configured to allow communication between computer system 1500, other computer systems (if any) that are part of the network-based site, other servers on the Internet, and computers used by customers of the network-based website elsewhere on the Internet. Network interface 1540 may commonly support one or more wireless networking protocols (e.g., Wi-Fi/IEEE 802.11, or another wireless networking standard). However, in various embodiments, network interface 1540 may support communication via any suitable wired or wireless general data networks, such as other types of Ethernet network, for example. Additionally, network interface 1540 may support communication via telecommunications/telephony networks such as analog voice networks or digital fiber communications networks, via storage area networks such as Fibre Channel SANs, or via any other suitable type of network and/or protocol.

In some embodiments, system memory 1520 may be one embodiment of a computer-accessible medium configured to store program instructions and data as described above. However, in other embodiments, program instructions and/or data may be received, sent or stored upon different types of computer-accessible media. Generally speaking, a computer-accessible medium may include storage media or memory media such as magnetic or optical media, e.g., disk or DVD/CD coupled to computer system 1500 via I/O interface 1530. A computer-accessible medium may also include any volatile or non-volatile media such as RAM (e.g. SDRAM, DDR SDRAM, RDRAM, SRAM, etc.), ROM, etc., that may be included in some embodiments of computer system 1500 as system memory 1520 or another type of memory. Further, a computer-accessible medium may include transmission media or signals such as electrical, electromagnetic, or digital signals, conveyed via a communication medium such as a network and/or a wireless link, such as may be implemented via network interface 1540.

CONCLUSION

Various embodiments may further include receiving, sending or storing instructions and/or data implemented in accordance with the foregoing description upon a non-transitory, computer-accessible medium. Generally speaking, a non-transitory, computer-accessible medium may include storage media or memory media such as magnetic or optical media, e.g., disk or DVD/CD-ROM, volatile or non-volatile media such as RAM (e.g. SDRAM, DDR, RDRAM, SRAM, etc.), ROM, etc. As well as transmission media or signals such as electrical, electromagnetic, or digital signals, conveyed via a communication medium such as network and/or a wireless link.

The various methods as illustrated in the Figures and described herein represent exemplary embodiments of methods. The methods may be implemented in software, hardware, or a combination thereof. The order of method may be changed, and various elements may be added, reordered, combined, omitted, modified, etc.

Various modifications and changes may be made as would be obvious to a person skilled in the art having the benefit of this disclosure. It is intended that the invention embrace all such modifications and changes and, accordingly, the above description to be regarded in an illustrative rather than a restrictive sense.

What is claimed is:

1. A system, comprising:

one or more data storage devices configured to store data for an enterprise, wherein said enterprise is controlled by an entity and offers items for order, wherein items ordered via said enterprise are fulfilled by two or more fulfillment networks, wherein one of the fulfillment networks is controlled by the entity controlling the enterprise, and wherein at least one other of the fulfillment networks is controlled by an entity distinct from the entity controlling the enterprise; and one or more servers configured to implement enterprise logic configured to:

obtain input identifying a user;

based upon the input identifying the user, determine whether the user is a current subscriber to a subscription-based shipping program;

obtain input specifying one or more items for display for the user;

in response to determining that the user is a current subscriber, provide display information to the user for the specified one or more items comprising:

for each of the specified items fulfilled by the fulfillment network controlled by the entity controlling the network-based site, send display information to the user indicating that the item is eligible for shipping under the subscription-based shipping program; and for each of the specified items fulfilled by one of the fulfillment networks controlled by an entity distinct from the entity controlling the network-based site:

determine a shipping origin for the item;

determine a predicted shipping destination for the user;

determine, based on the shipping origin and the predicted shipping destination, whether the item is eligible for shipping under the subscription-based shipping program; and in response to determining that the item is eligible for shipping under the subscription-based shipping program, sending display information to the user indicating that the item is eligible for shipping under the subscription-based shipping program.

2. The system of claim 1, wherein, to determine a predicted shipping destination for the user, the enterprise logic is configured to access a user database to determine a default shipping address of the user.

3. The system of claim 1, wherein, to determine, based on the shipping origin and the predicted shipping destination, whether the item is eligible for shipping under the subscription-based shipping program, the enterprise logic is configured to:

access shipping performance data for one or more shipping carriers;

determine one or more shipping timeframes according to the shipping performance data based upon the shipping origin and the predicted shipping destination; and compare each determined shipping timeframe according to a delivery timeframe threshold to determine whether the item is eligible for shipping under the subscription-based shipping program.

4. The system of claim 1, wherein the enterprise logic is further configured to:

determine whether a fulfillment network is eligible to fulfill items for the subscription-based shipping program, comprising:

access fulfillment network performance data from a database;

determine a performance measure for the fulfillment network using the fulfillment network performance data; and determine whether the performance measure exceeds one or more subscription-based shipping program participation thresholds to determine whether the fulfillment network is eligible to fulfill items for the subscription-based shipping program.

5. A method, comprising:

performing, by one or more computing devices:

sending, in response to a request from a user to a network-based site, display information for one or more items, wherein the one or more items are selectable for ordering via the network-based site for fulfillment by a different entity than an entity controlling the network-based site;

prior to a particular one of the one or more items being selected for an order by a given user of the network-based site:

determining whether the user is a subscriber of a subscription-based shipping program eligible for an enhanced shipping option;

determining a shipping origin and a predicted shipping destination for the item;

determining whether the particular item is eligible for the enhanced shipping option based on whether the particular item can be shipped by the different entity from the shipping origin to arrive at the predicted shipping destination within a timeframe specified for the enhanced shipping option; and in response to determining that the user is a subscriber of a subscription-based shipping program eligible for the enhanced shipping option and that the particular item is eligible for the enhanced shipping option, including in the display information an indication that the particular item is eligible for the enhanced shipping option.

6. The method of claim 5, wherein items ordered via said network-based site are fulfilled by two or more fulfillment networks, wherein one of the fulfillment networks is controlled by the entity controlling the network-based site, wherein at least one other of the fulfillment networks is controlled by the different entity distinct from the entity controlling the network-based site, and wherein the selectable one or more items for offering via the network-based site are fulfilled by the fulfillment network controlled by the different entity.

7. The method of claim 5, wherein whether the particular item can be shipped by the different entity from the shipping origin to arrive at the predicted shipping destination within a timeframe is determined based on shipping the particular item via a ground shipping service.

8. The method of claim 5, wherein the display information provides a user interface configured to accept a user order for a particular item, wherein said user interface displays one or more shipping user interface elements, wherein at least one of said one or more shipping user interface elements displays the indication that the particular item is eligible for the enhanced shipping option, and if selected the at least one of said one or more shipping user interface elements orders the particular item with the enhanced shipping option.

9. The method of claim 5, wherein said determining a predicted shipping destination comprises:

identifying an internet protocol address of the user request to the network-based site; and performing a geolocation technique upon the identified internet protocol address to determine the predicted shipping destination.

10. The method of claim 5, wherein said determining a predicted shipping destination comprises accessing a user database to determine a default shipping address of the user.

11. The method of claim 5, further comprising:

wherein said request from a user is a request from a mobile device accessing the network-based site;

wherein said determining a predicted shipping destination comprises determining a geographic area from which the mobile device accessed the network-based site.

12. The method of claim 11, further comprising:

wherein said obtaining input at the network-based site from the user providing the predicted shipping destination modifies the predicted shipping destination;

in response to obtaining input at the network-based site from the user providing the predicted shipping destination:

determining, based on the shipping origin and the modified predicted shipping destination, whether the particular item is eligible for the enhanced shipping option; and in response to determining that the particular item is not eligible for the enhanced shipping option, including in the display information an indication that the particular item is no longer eligible for the enhanced shipping option.

13. The method of claim 5, wherein said determining whether the particular item is eligible for the enhanced shipping option comprises:

determining one or more shipping timeframes according to one or more shipping carriers based upon the shipping origin and the predicted shipping destination; and comparing each determined shipping timeframe according to a delivery timeframe threshold to determine whether the particular item is eligible for the enhanced shipping option.

14. The method of claim 13, said wherein said determining one or more shipping timeframes according to one or more shipping carriers based upon the shipping origin and the predicted shipping destination comprises:

providing to a shipping carrier the shipping origin and the predicted shipping destination; and receiving from the shipping carrier the shipping timeframe corresponding to the provided shipping origin and the provided predicted shipping destination.

15. The method of claim 13, wherein said determining one or more shipping timeframes according to one or more shipping carriers based upon the shipping origin and the predicted shipping destination comprises:

accessing shipping performance data for one or more shipping carrier from a database, wherein the shipping performance data corresponds to orders delivered from the shipping origin to a shipping region including the predicted shipping destination; and calculating a shipping timeframe for the predicted shipping destination based upon the shipping performance data.

16. The method of claim 5, wherein said determining whether the particular item is eligible for the enhanced shipping option comprises:

obtaining from a shipping carrier delivery destinations according to the shipping origin and the specified delivery timeframe for the enhanced shipping option, wherein the delivery destinations comprise the possible shipping locations for an order to be delivered by the shipping carrier within the specified delivery time frame; and determining whether the predicted shipping destination is one of the obtained delivery destinations to determine whether the item is eligible for the enhanced shipping option.

17. The method of claim 5, wherein said determining whether the user is a subscriber eligible for an enhanced shipping option comprises:

obtaining from the user identification information; and based upon the user identification information, determining whether the user is a current subscriber to a subscription-based shipping program;

wherein the enhanced shipping option is one of one or more of a plurality of shipping options in the subscription-based shipping program.

18. The method of claim 5, further comprising:

obtaining input at the network-based site selecting at least one of the selectable one or more items for ordering via the network-based site that the user wants to order;

in response to obtaining said input selecting at least one of the one or more items that the user wants to order, generating an order for the selected at least one item directing the at least one item to be shipped according to the enhanced shipping option;

sending the generated order to a corresponding fulfillment network for the selected at least one item, wherein the corresponding fulfillment network is controlled by the different entity distinct from the entity controlling the network-based site; and recording the generated order in a database.

19. The method of claim 18, further comprising sending to the corresponding fulfillment network a shipping label for the order for a particular shipping carrier and a shipping tracking identifier for the order for the particular carrier.

20. The method of claim 19, further comprising:

using the shipping tracking identifier to determine a delivery time for the at least one item;

determining whether the delivery time exceeds a specified delivery timeframe;

in response to determining the delivery time exceeds a specified delivery timeframe performing a corrective action.

21. The method of claim 20, wherein said corrective action comprises:

sending a cancellation order for the at least one item to the corresponding fulfillment network; and sending the generated order to another fulfillment network.

22. The method of claim 18, wherein sending the generated order to the corresponding fulfillment network for the selected at least one item comprises providing the fulfillment network access to a user interface configured to display sent orders corresponding to the fulfillment network.

23. The method of claim 5, further comprising obtaining at the network-based site a request from a fulfillment network to submit one or more additional items selectable for ordering via the network-based site for the enhanced shipping option, wherein the fulfillment network is controlled by the different entity distinct from the entity controlling the network-based site.

24. The method of claim 23, further comprising in response said obtaining at the network-based site the request from the fulfillment network to submit one or more additional items selectable for ordering via the network-based site for the enhanced shipping option, providing the fulfillment network with access to a user interface, wherein the user interface is configured to accept submissions of one or more additional items selectable for ordering via the network-based site, wherein said user interface displays a plurality of submission user interface elements, and wherein the plurality submission user interface elements are configured to obtain:

item identifiers of the one or more additional items;

quantities of the one or more additional items; and shipping origin locations of the one or more additional items.

25. A non-transitory, computer-readable storage medium, storing program instructions, wherein the program instructions are computer-executable to implement a shipping management application for a network-based site, wherein said shipping management application is configured to implement:

sending, in response to a request from a user to the network-based site, display information for one or more items, wherein the one or more items are selectable for ordering via the network-based site for fulfillment by a different entity than an entity controlling the network-based site;

prior to a particular one of the one or more items being selected for an order by a given user of the network-based site:

determining whether the user is a subscriber of a subscription-based shipping program eligible for an enhanced shipping option;

determining a shipping origin and a predicted shipping destination for the item;

determining whether the particular item is eligible for the enhanced shipping option based on whether the particular item can be shipped by the different entity from the shipping origin to arrive at the predicted shipping destination within a timeframe specified for the enhanced shipping option; and in response to determining that the user is a subscriber of a subscription-based shipping program eligible for the enhanced shipping option and that the particular item is eligible for the enhanced shipping option, including in the display information an indication that the particular item is eligible for the enhanced shipping option.

* * * * *